US005535127A

United States Patent [19]

Uno et al.

[11] Patent Number: 5,535,127

[45] Date of Patent: Jul. 9, 1996

[54] PROCESSING APPARATUS FOR MAIL WITH STAMPS

[75] Inventors: Teruhiko Uno, Tokyo; Toshio Hirasawa, Kawasaki; Toshio Sato; Kazuyo Nakagawa, both of Yokohama; Hiroshi Takahashi, Okegawa, all of Japan

[73] Assignee: Kabushiki Kaisha Toshiba, Kawasaki, Japan

[21] Appl. No.: 275,420

[22] Filed: Jul. 15, 1994

[30] Foreign Application Priority Data

Jul. 16, 1993 [JP] Japan ..... 5-197744

[51] Int. Cl.[6] ..... G07B 17/00

[52] U.S. Cl. ..... 364/464.02; 356/383; 356/384; 356/385; 364/464.03; 382/101

[58] Field of Search ..... 356/379, 381, 356/383, 384, 385; 364/464.02, 464.03; 382/101

[56] References Cited

U.S. PATENT DOCUMENTS

| | | | |
|---|---|---|---|
| 3,513,444 | 5/1970 | Henderson et al. | 356/379 X |
| 3,587,856 | 6/1971 | Lemelson | 382/101 X |
| 3,983,366 | 9/1976 | Gunn | 235/454 X |
| 4,138,735 | 2/1979 | Allocca et al. | 364/464.02 |
| 4,495,581 | 1/1985 | Piccione | 364/464.03 |
| 4,499,545 | 2/1985 | Daniels et al. | 364/464.02 |
| 4,506,330 | 3/1985 | Dlugos | 364/464.03 |
| 4,868,757 | 9/1989 | Gil | 364/464.03 |
| 5,001,648 | 3/1991 | Baker | 364/464.03 |
| 5,019,991 | 5/1991 | Sansone et al. | 364/464.03 |
| 5,119,306 | 6/1992 | Metelits et al. | 364/464.02 |

FOREIGN PATENT DOCUMENTS 212021 1/1990 Japan .

*Primary Examiner*—Edward R. Cosimano
*Attorney, Agent, or Firm*—Cushman Darby & Cushman

[57] ABSTRACT

An automatic mail processing apparatus comprises a physical quantity detection section for detecting physical quantities of mail with a stamp, such as the weight and dimensions of the mail, a postage determining section for determining the valid postage for the mail with reference to a table in which valid charges are previously stored on the basis of the information items indicating physical quantities, and a stamp detection section for detecting the amount paid on the basis of the information on the stamp contained in the image of the mail, and a processing section for verifying the determined postage with the amount paid to detect a surplus or deficit of the amount paid, and to identify the kind of the mail, classify the mail, and compile statistics data on the mail.

11 Claims, 35 Drawing Sheets

Xt
X1 = 0
X2 = 0
1
1
1
⇒ XS
1
0
⇒ XE
Xh=0
Yt
Y1 Y2
YS
YE
YW
210-□□
○○○

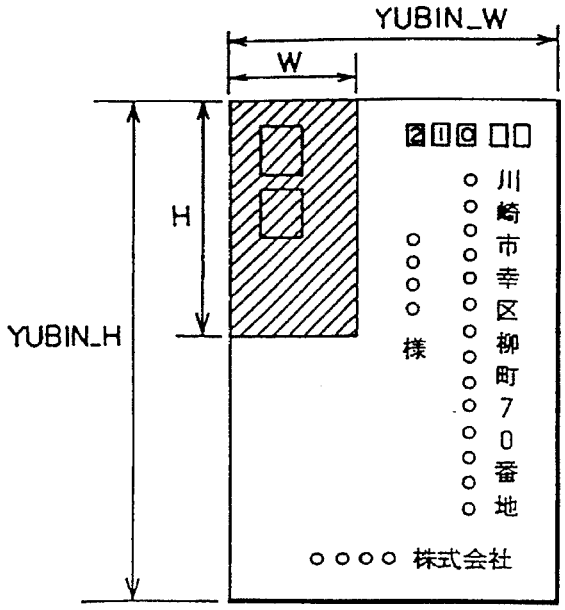
YUBIN_W
W
H
YUBIN_H
○○○○様
○○○○

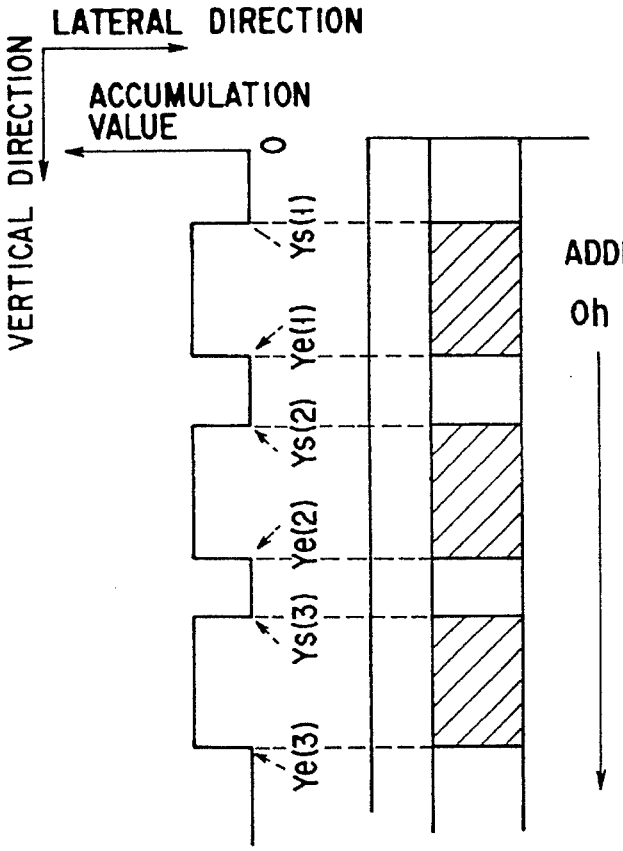
FIG. 28
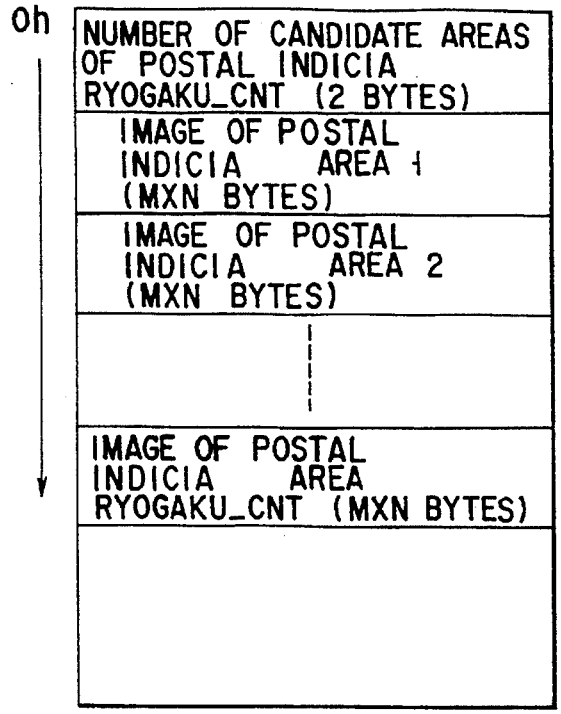
FIG. 30
FIG. 29 (a)
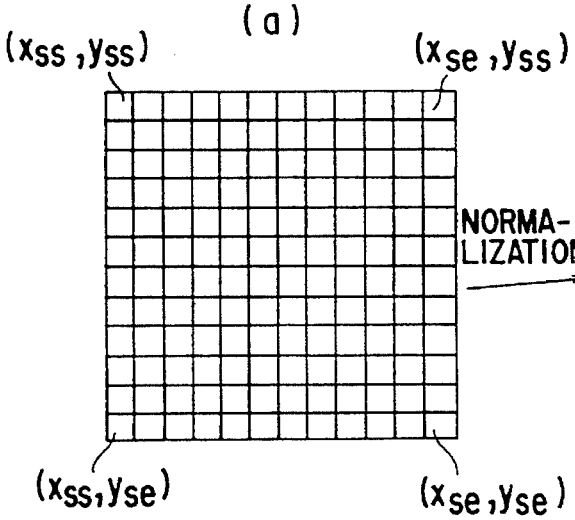
FIG. 29 (b)
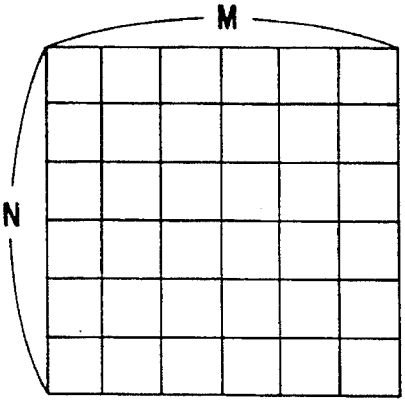

| ADDRESS | |
|---|---|
| 0h | NUMBER OF DICTIONARYES JISHO_CNT+1 (2 BYTES) |
| | POSTAGE IN DICTIONARY 1 (2 BYTES) |
| | POSTAGE IN DICTIONARY 2 (2 BYTES) |
| | ⋮ |
| | POSTAGE OF DICTIONARY JISHO_CNT (2 BYTES) |
| | POSTAGE OF DICTIONARY JISHO_CNT+1 (2 BYTES) |
| 500h | ⋮ |
| | KIND DATA OF POSTAL INDICIA ON DICTIONARY 1 (2 BYTES) |
| | KIND DATA OF POSTAL INDICIA ON DICTIONARY 2 (2 BYTES) |
| | ⋮ |
| | KIND DATA OF POSTAL INDICIA IN DICTIONARY JISHO_CNT (2 BYTES) |
| | KIND DATA OF POSTAL INDICIA IN DICTIONARY JISHO_CNT+1 (2 BYTES) |
| 1000h | ⋮ |
| | DICTIONARY PATTERN OF DICTIONARY 1 (MXN BYTES) |
| | DICTIONARY PATTERN OF DICTIONARY 2 (MXN BYTES) |
| | ⋮ |
| | DICTIONARY PATTERN IN DICTIONARY JISHO_CNT (MXN BYTES) |
| | DICTIONARY PATTERN IN DICTIONARY JISHO_CNT+1 (MXN BYTES) |
| | ⋮ |

FIG. 35

| MAIL CLASSIFICATION No. | CLASS | STANDARD/ NON-STANDARD | WEIGHT | POSTAGE | SPECIAL DELIVERY POSTAGE |
|---|---|---|---|---|---|
| 1 | FIRST-CLASS | STANDARD SIZE | UP TO 25g | 62 | 272 |
| 2 | | | UP TO 50g | 72 | 282 |
| 3 | | NON-STANDARD SIZE | UP TO 50g | 120 | 330 |
| 4 | | | UP TO 100g | 175 | 385 |
| 5 | | | UP TO 250g | 250 | 460 |
| 6 | | | UP TO 500g | 360 | 670 |
| 7 | | | UP TO 1kg | 670 | 980 |
| 8 | | | UP TO 2kg | 930 | 1500 |
| 9 | | | UP TO 3kg | 1130 | 1700 |
| 10 | | | UP TO 4kg | 1340 | 1910 |
| 0 | SECOND-CLASS | ORDINARY POSTCARD | | 41 | 251 |

FIG. 36

| KUBUN_KIND | KIND OF MAIL |
|---|---|
| 1 | STANDARD SIZE, POSTCARD |
| 2 | NONSTANDARD |
| 3 | POSTAGE DUE |
| 4 | SPECIAL DELIVERY |
| 5 | NOT A PIECE OF MAIL (REJECT) |

FIG. 40

(2 BYTES)

| | |
|---|---|
| TEIKEI_K1 | |
| 〃 K2 | |
| 〃 K3 | |
| 〃 J | |
| GAI_K1 | |
| 〃 K2 | |
| 〃 K3 | |
| 〃 K4 | |
| 〃 J | |
| JURYO_T1 | |
| JURYO_G1 ~ JURYO_G7 | 14 BYTES |
| RYOKIN_N1 ~ RYOKIN_N10 | 20 BYTES |
| RYOKIN_R1 ~ RYOKIN_R10 | 20 BYTES |
| HAGAKI_K1 | |
| 〃 K2 | |
| RYOKIN_N0 | |
| RYOKIN_R0 | |

FIG. 38

| ADDRESS | | |
|---|---|---|
| 00h | TOTAL NUMBER AT YUBIN_KIND=0 | (4 BYTES) |
| | TOTAL POSTAGE AT YUBIN_KIND=0 | ( 〃 ) |
| | TOTAL NUMBER AT YUBIN_KIND=1 | ( 〃 ) |
| | TOTAL POSTAGE AT YUBIN_KIND=1 | ( 〃 ) |
| | TOTAL NUMBER AT YUBIN_KIND=2 | ( 〃 ) |
| | TOTAL POSTAGE AT YUBIN_KIND=2 | ( 〃 ) |
| | TOTAL NUMBER AT YUBIN_KIND=3 | ( 〃 ) |
| | TOTAL POSTAGE AT YUBIN_KIND=3 | ( 〃 ) |
| | ⋮ | |
| | TOTAL NUMBER AT YUBIN_KIND=10 | (4 BYTES) |
| 58h | TOTAL POSTAGE AT YUBIN_KIND=10 | ( 〃 ) |
| | TOTAL NUMBER AT YUBIN_KIND=4 | ( 〃 ) |
| 60h | TOTAL POSTAGE AT YUBIN_KIND=4 | ( 〃 ) |
| | TOTAL NUMBER AT YUBIN_KIND=3 | ( 〃 ) |
| 68h | TOTAL POSTAGE DUE AT YUBIN_KIND=3 | ( 〃 ) |
| | TOTAL NUMBER AT YUBIN_KIND=5 | ( 〃 ) |
| 6ch | TOTAL NUMBER | ( 〃 ) |
| | TOTAL POSTAGE | ( 〃 ) |

FIG. 42

| OFFSET ADDRESS | | |
|---|---|---|
| 0h | STORAGE AREA FOR STATISTICS DATA | |
| | ⋮ | |
| RESULT_OFF | RESULT_CNT | (4 BYTES) |
| | ⋮ | |
| RESULT_OFF + 22 × i | YUBIN_ID (=i) | (4 BYTES) |
| | KEIJO_W WHEN YUBIN_ID=i | (2 BYTES) |
| | KEIJO_H WHEN YUBIN_ID=i | (2 BYTES) |
| | KEIJO_T WHEN YUBIN_ID=i | (2 BYTES) |
| | JURYO WHEN YUBIN_ID=i | (2 BYTES) |
| | YUBIN_KIND WHEN YUBIN_ID=i | (2 BYTES) |
| | RYOKIN_TTL WHEN YUBIN_ID=i | (2 BYTES) |
| | KUBUN_KIND WHEN YUBIN_ID=i | (2 BYTES) |
| | SAGAKU WHEN YUBIN_ID=i | (2 BYTES) |
| | INMEN_KIND WHEN YUBIN_ID=i | (2 BYTES) |
| RESULT_OFF + 22 × (i+1) | ⋮ | |

FIG. 44

PROCESSING APPARATUS FOR MAIL WITH STAMPS

BACKGROUND OF THE INVENTION

1. Field of the Invention

This invention relates to an apparatus for processing an object such as mail wherein the type or the kind of the mail, processing/charges, etc. are detected from a postal indicia (like a stamp) and wherein physical quantities such as weight, dimensions, etc. are measured.

2. Description of the Related Art

In connection with a conventional method of determining the processing charges for mail etc., a postage determining apparatus as disclosed in Jpn. Pat. Appln. KOKAI Publication No. 2-12021 has been proposed. This apparatus enables the postage for a specified piece of mail to be read from a postage table previously stored in a nonvolatile memory and then displayed, and compared with the weight data on the piece of mail weighed at the metering section, thereby indicating the postage and the classification of the mail. With this prior art, however, only the weight is measured as physical information on a piece of mail, but the shape or size, which is one of elements determining the postage, is not measured. The operator is still required to judge and enter the kind of mail (standard-size mail, nonstandard-size mail, etc.) from the keyboard. Furthermore, only the necessary postage for the measured weight is displayed. The apparatus is not constructed so as to detect the postal indicia on a piece of mail, for example, the postal indicia of a postage stamp or an indicia by a postage meter or to automatically classify a piece of mail on the basis of the detection result.

Therefore, with such a conventional apparatus, the valid postage may not be indicated because the operator may make a mistake in judgment of the kind of the mail. Furthermore, there are various disadvantages including a heavy burden on the operator.

SUMMARY OF THE INVENTION

It is, accordingly, an object of the present invention to overcome the disadvantages by providing an object processing apparatus which measures the physical quantity information items about an object in connection with the decision of a processing charge for processing the object, calculates a valid charge on the basis of a charge table with respect to the previously stored physical quantities, detects the amount of money of the postal indicia on the object through an image information process, identifies the type of the object (e.g., the kind of mail) from the relationship between them, displays the information on a display, sorts out the piece of mail by classification, and totals the statistical data on charges, and which is automated so as to alleviate a burden on the operator, thereby preventing charges from being displayed erroneously due to misjudgment.

According to an aspect of the present invention, there is provided a mail processing apparatus comprising: means for detecting physical quantities of mail provided with a stamp so as to determine a processing charge of the mail; first determining means for determining the processing charge of the mail in accordance with the physical quantities detected by the detecting means; means for storing a plurality of reference images corresponding to images of a plurality of stamps of different postal indicia; means for extracting the images of the stamps of the mail; second determining means for determining a postal indicia of the stamp of the mail by comparing the image extracted by the extracting means with the plurality of reference images stored in the storing means; means for verifying the processing charge determined by the first determining means and the postal indicia of the mail determined by the second determining means; and third determining means for determining a processing method of the mail based on a verification result obtained by the verifying means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 26 shows an example of the postal indicia area in a mail image;

FIG. 27 shows an example of obtaining the postal indicia area in the longitudinal direction of mail;

FIG. 28 shows an example of obtaining the postal indicia area in the lateral direction of mail;

FIG. 29 shows an example of normalizing the postal indicia area;

FIG. 30 illustrates an example of the address map of the postal indicia image memory;

FIG. 35 shows an example of the address map of the postal indicia dictionary memory at the time of entering a new dictionary pattern;

FIG. 36 shows a list of postal rates;

FIG. 38 is a postage look-up table;

FIG. 40 shows the kind of postal matters or mail;

FIG. 42 shows a state where statistical data items are stored in the memory;

FIG. 44 shows a state where different statistical data items are stored in the memory;

DETAILED DESCRIPTION OF THE PREFERRED EMBODIMENTS

Hereinafter, an embodiment of the present invention will be explained, referring to the accompanying drawings. This invention can be applied to any object with postal indicia on its surface as well as mail. The explanation below will be given as to an embodiment where the invention is applied to a mail processing apparatus.

Figure 2:
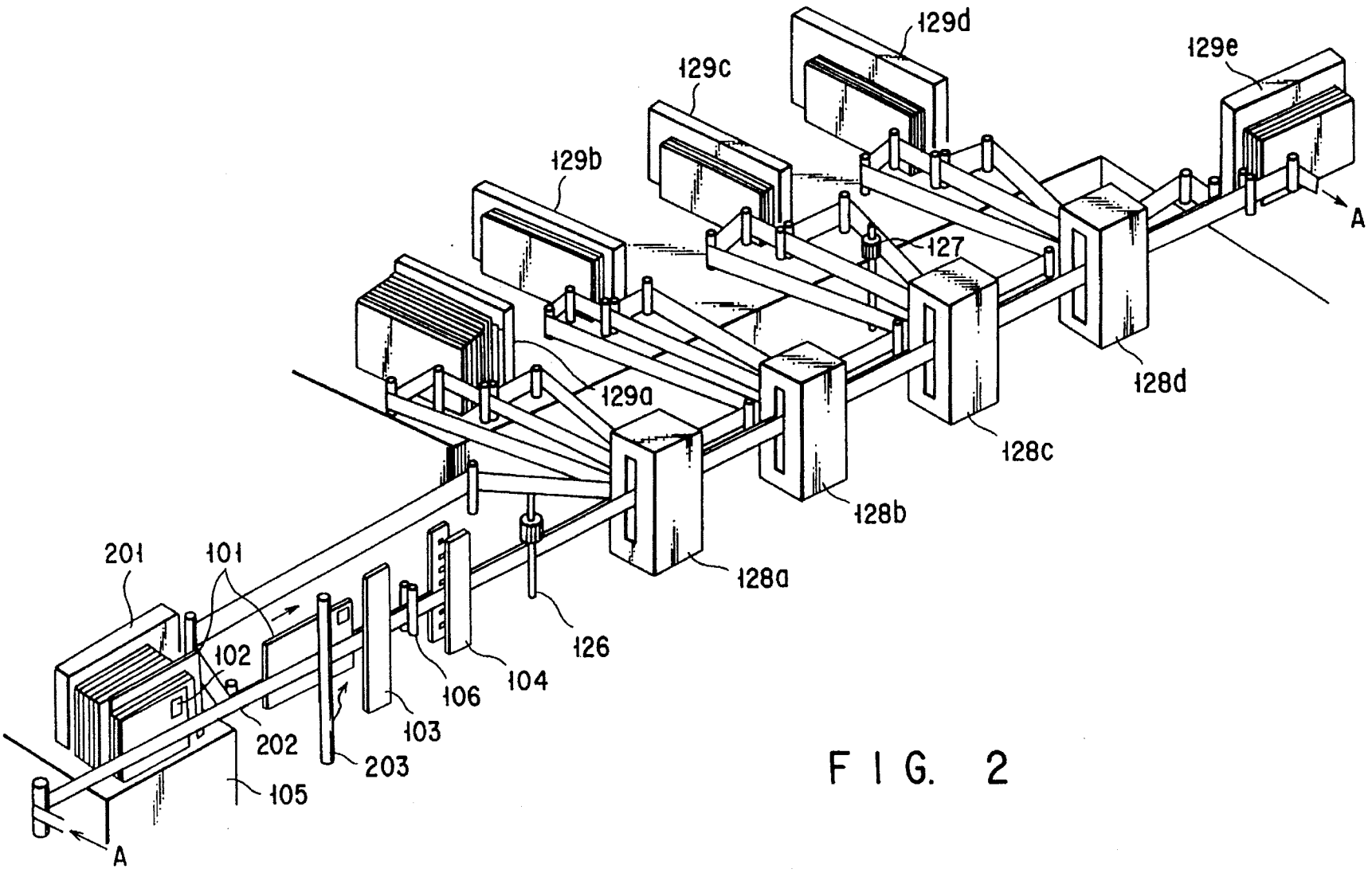
FIG. 2 is a perspective view of the mechanical section of the embodiment of FIG. 1.

FIG. 2 is a schematic diagram of the mechanism of a mail processing apparatus according to an embodiment of the present invention. To simplify the explanation of the operation of the system according to the embodiment, only the sensing mechanism of the processing apparatus is shown in FIG. 2.

Before the processing apparatus starts an operation, pieces of mail 101 are set in a mail feeder 201 with their postal indicia 102 facing the sensing face of an optical read sensor 103. The postal indicia indicates postage. The mail feeder 201 holds pieces of mail and performs control so that the first or top piece of mail may be pressed against a transport belt 202 at a constant pressure. This control causes pieces of mail to be conveyed one by one with the transport belt 202. The mail feeder 201 contains a weight sensor 105 for sensing the total weight of the pieces of mail put in the feeder 201. The weight sensor 105 measures the total weight of the remaining pieces of mail each time each piece is taken out. A mail weight sensing section (explained later) calculates the difference between the currently measured total weight and the previously measured one to obtain the weight of one piece of mail being sensed.

The piece of mail taken out of the mail feeder 201 and conveyed by the transport belt 202 is illuminated by a light source 203 such as a fluorescent lamp. Its reflected light is read by the optical read sensor 103. In the embodiment, the optical read sensor 103 is a one-dimensional line sensor and produces two-dimensional image information by transporting the mail in the direction perpendicular to the line of the sensor. Then, a thickness sensor 106 measures the thickness of a piece of mail, and a size sensor 104 using, for example, a photosensor array, measures the outer dimensions of a piece of mail. Of those sensors, the optical read sensor 103 is provided to sense the postal indicia impression 102 indicating postage, and the remaining sensors are provided to measure the physical quantities determining postage. The position of the sensors is not necessarily in the order of FIG. 2 as long as they do not affect the system configuration.

A postmark stamper 126 is a device for postmarking the postal indicia to indicate that the stamp is valid and already used, and operates only when the postal indicia is detected from the image information obtained from the optical read sensor 103. The pieces of mail passed through the postmark stamper 126 are distributed to mail stackers **129*a* to 129*e* by mail distributors 128*a* to 128*d* on the basis of the operation charge information determined according to the measured physical quantities of the pieces of mail. Then, the distributors perform post-processing according to the respective postage. Postage-due mark stamping machine 127** stamps a mark indicating postage due on a postage-due piece of mail.

Figure 1:
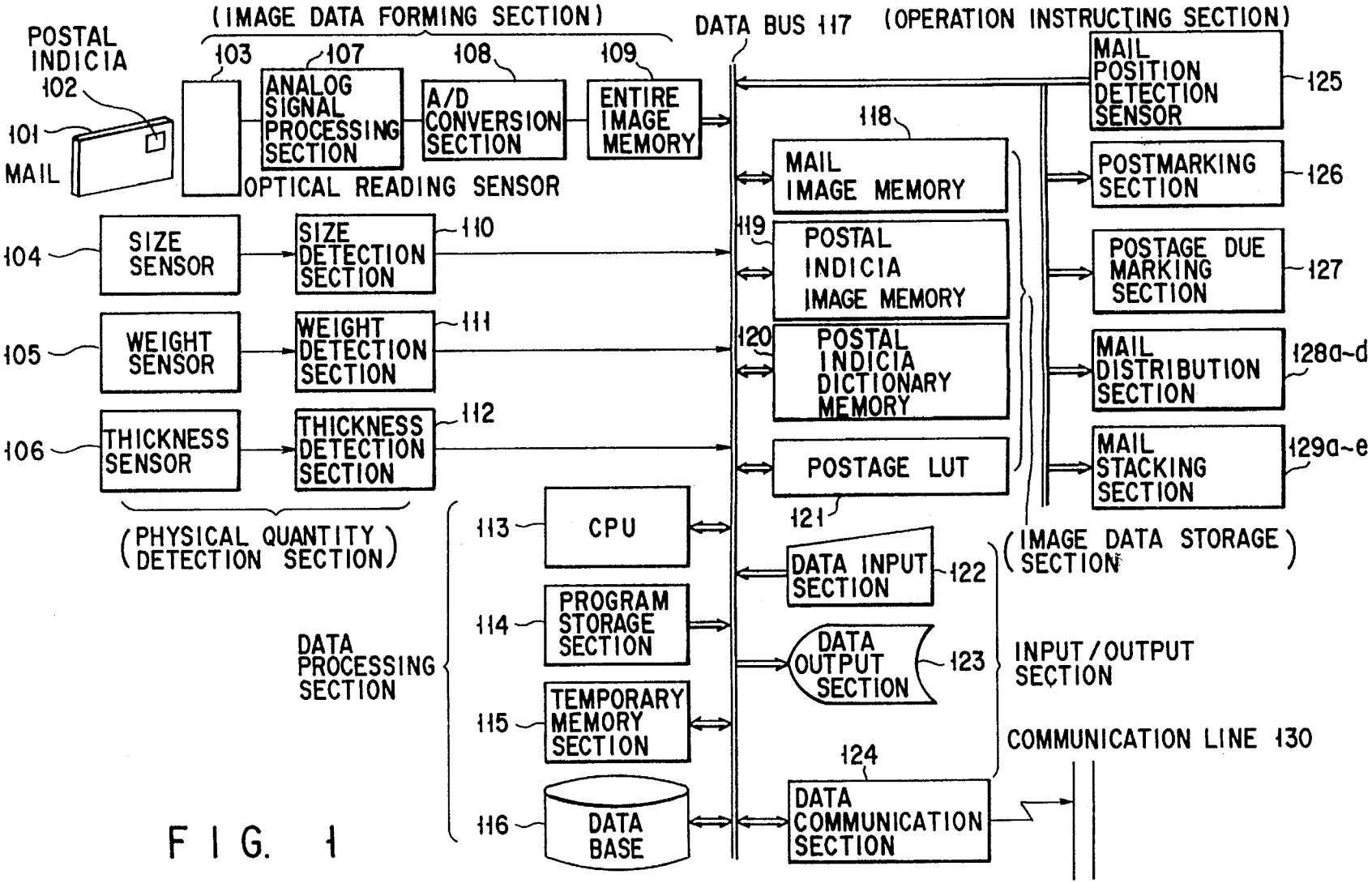
FIG. 1 is an overall block diagram of an embodiment of the present invention.

The processing flow of the postage determining system will be explained using FIG. 1. In FIG. 1, there are roughly six functional blocks. After a general description of each block is given, each block will be explained in detail.

A physical quantity detection section is composed of a sensor for sensing the physical characteristics of a piece of mail to be read and a detection circuit. A size sensor 104, a weight sensor 105, and a thickness sensor 106 are used to sense the size, the weight, and the thickness, respectively. In the detection section, the size signal from the size sensor 104 is quantified by a size detection section 110 to obtain the length and width of a piece of mail. Since the total weight of the remaining pieces of mail in the mail feeder 201 can be known from the weight sensor 105 each time a piece of mail is conveyed, the weight of the piece of mail being transported is calculated by obtaining the difference between the current total weight and that one piece ahead. Because the voltage signal proportional to the thickness of a piece of mail is obtained from the thickness sensor 106, the voltage value is converted into the thickness at a thickness detection section 112. The detected results from the size detection section 110, weight detection section 111, and thickness detection section 112 are all in the form of a digital signal and read by a CPU 113 via a data bus 117.

An image data generating section has the function of determining only the mail image portion from the image data obtained from the optical read sensor 103 in the form of digital signal via an analog signal processing section 107, an A/D converting section 108, and an entire image memory 109. Here, the A/D conversion means converting a continuous analog image signal into a digital image signal which can be processed by a computer. In sensing the shape or size of a piece of mail, the size data from the size sensor 104 is also referred to. The sensed image of a piece of mail is temporarily stored in a mail image memory 118 via the data bus 117.

Data processing section comprises the CPU 113 which performs the main control of the entire system, a program storage section 114 which stores programs for image processing and system operations, a temporary memory section 115 which temporarily stores the processing data during the execution of a program, and a data storage section or a data base 116 composed of a nonvolatile memory. The data storage section 116 stores a system start-up program, OS (Operating System), and other application programs needed for the system, or the history of system operations and sum total data such as the sum total of charges.

An image data storage section comprises a mail image memory 118 for storing the image of the entire piece of mail, a postal indicia image memory 119 for storing the image of the postal indicia portion obtained from the image processing at the data processing section, a postal indicia dictionary memory 120 for storing the dictionary pattern of postal indicia, and a postage LUT (look-up table) 121 which shows the relationship between the sizes and weights of mail and postage.

An input/output section effects an interface (I/F) operation between the present system and the external system and comprises a data input section 122 such as a keyboard, a data output section 123 such as a CRT, and a data communication section 124 such as a modem connected to an external communication line 130.

Lastly, an operation instructing section has the function of receiving the discrimination result from the data processing section and giving the system instructions to operate. When the postal indicia to be stamped such as a postmark is sensed on the current piece of mail, the CPU 113 gives the postmark stamper 126 instructions to affix a seal. The timing of postmarking the piece of mail is adjusted on the basis of the sense signals from a plurality of mail position sensors 125 provided on the transport path. The mail distribution means 128*a* to 128*d* distribute pieces of mail to mail stackers 129*a* to 129*d* according to whether the postal indicia is valid, higher or lower than the correct value, and when it is valid, whether it is standard-size or nonstandard-size mail on the basis of the shape and size of a piece of mail, its weight information, and the discrimination result of postal indicia. It is determined from the relationship between the postal indicia and the physical quantities whether it is ordinary mail or special delivery. What exceeds the range of mail in terms of size and weight is rejected and collected in the mail stacker 129*e*. Only when the postage is insufficient, the postage due mark stamping means 127 stamps a mark indicating postage due on the piece of mail.

Figure 3:
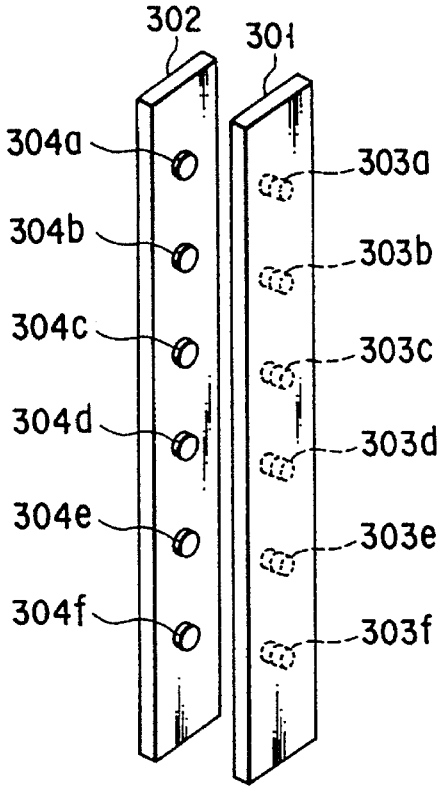
FIG. 3 is a perspective view of a size sensor.

Hereinafter, each functional block will be described in detail. First, the physical quantity detection section will be explained. FIG. 3 shows an example of the size sensor 104 composed of a light-emitting diode array 301 and a photodiode array 302. Rays of light from the individual light-emitting diodes 303*a* to 303*f* are always projected onto photodiodes 304*a* to 304*f* facing the light-emitting diodes. The light-emitting diode is an element that converts energy emitted at the time of recombination of carriers into light, making use of the p-n junction of a semiconductor. On the other hand, the photodiode is a photoelectric transducer that generates holes and electrons within a semiconductor and thereby allows current to flow by projecting light on the p-n junction of the semiconductor. Specifically, while the light from the light-emitting diode is being projected onto the photodiode, a current is generated in the photodiode. By allowing the current to flow through a suitable load resistance, a specific voltage is obtained. Binarizing the voltage with a comparator makes it possible to judge whether or not light is being projected on the photodiode. Since a piece of mail is to pass between two arrays 301, 302, it is possible not only to recognize the timing of the piece of mail passing, but also to determine the width of the piece of mail from the number of shaded photodiodes. On the other hand, the length of the piece of mail is computed on the basis of the time during which the photodiodes are shaded and the transporting speed of the piece of mail.

Figure 4:
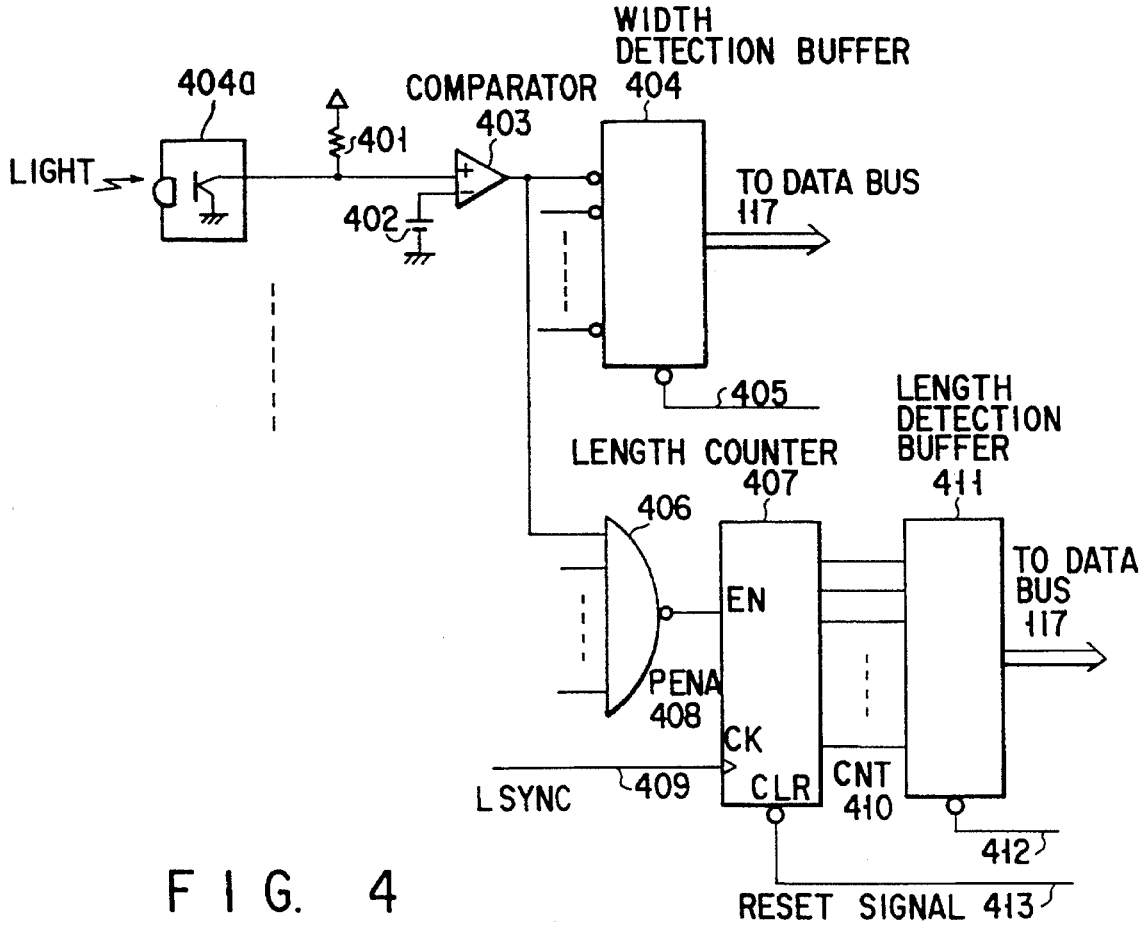
FIG. 4 is a circuit block diagram of a size detection section.
Figure 5:
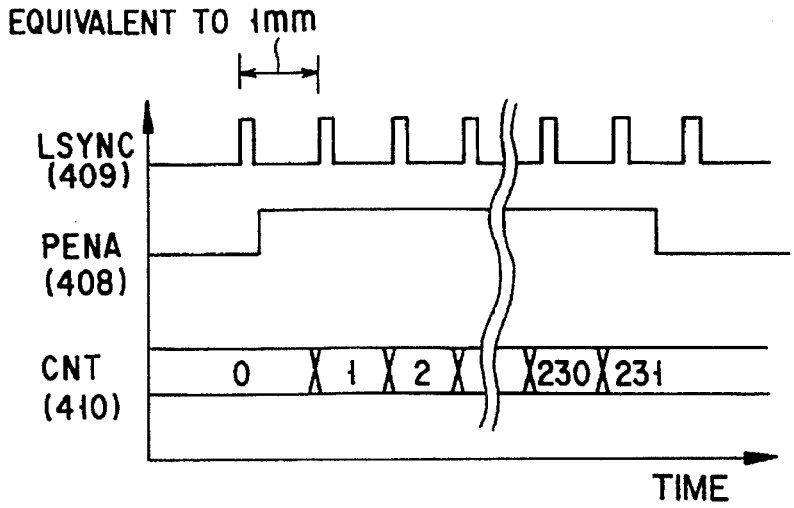
FIG. 5 is a timing chart to explain the operation of the size detection section.

The circuit diagram of the size detection section 110 for detecting the size of a piece of mail is shown in FIG. 4 and its timing chart is shown in FIG. 5. In FIG. 4, reference characters 404*a* indicate a photodiode provided at lower end of the array 302. When light is projected onto the photodiode 404*a* from the corresponding light-emitting diode in the array 301, current will flow in the base section of the p-n junction, thereby allowing the current amplified according to the characteristics of the semiconductor to flow between the collector and emitter. This signal is further amplified and taken out as the open collector output. The output signal is converted into a voltage at a pull-up resistor 401, and then is compared with a reference voltage 402 at a comparator 403. If it is higher than the reference voltage, then logic "1" is produced from the comparator 403. If it is lower than the reference voltage, logic "0" is produced. In the circuit of the embodiment, when light strikes the photodiode 404*a*, a bright signal or a current will flow through the diode 404*a*, thus placing the "+" input of the comparator 403 at almost 0 V. As a result, the output of the comparator 403 becomes logic "0." When no light strikes, a dark signal will be generated.

The bright and dark signals from the photodiodes are outputted via corresponding comparators and supplied to a width detection buffer 404 via inverters, respectively. The output of the buffer 404 is connected to the data bus 117 of the system so as to be accessible from the CPU 113 via a size read signal 405.

Figure 6:
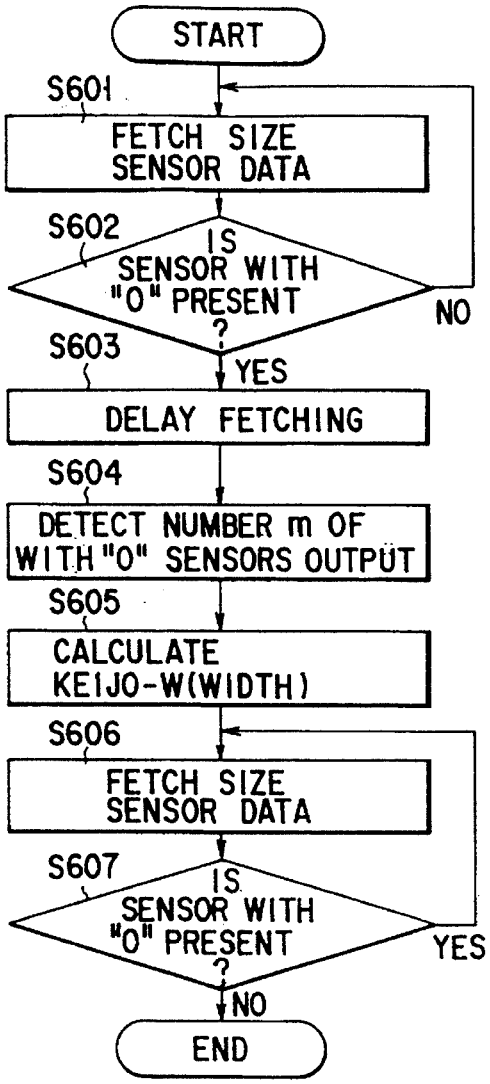
FIG. 6 is a flowchart for a mail width measuring process.
Figure 19:
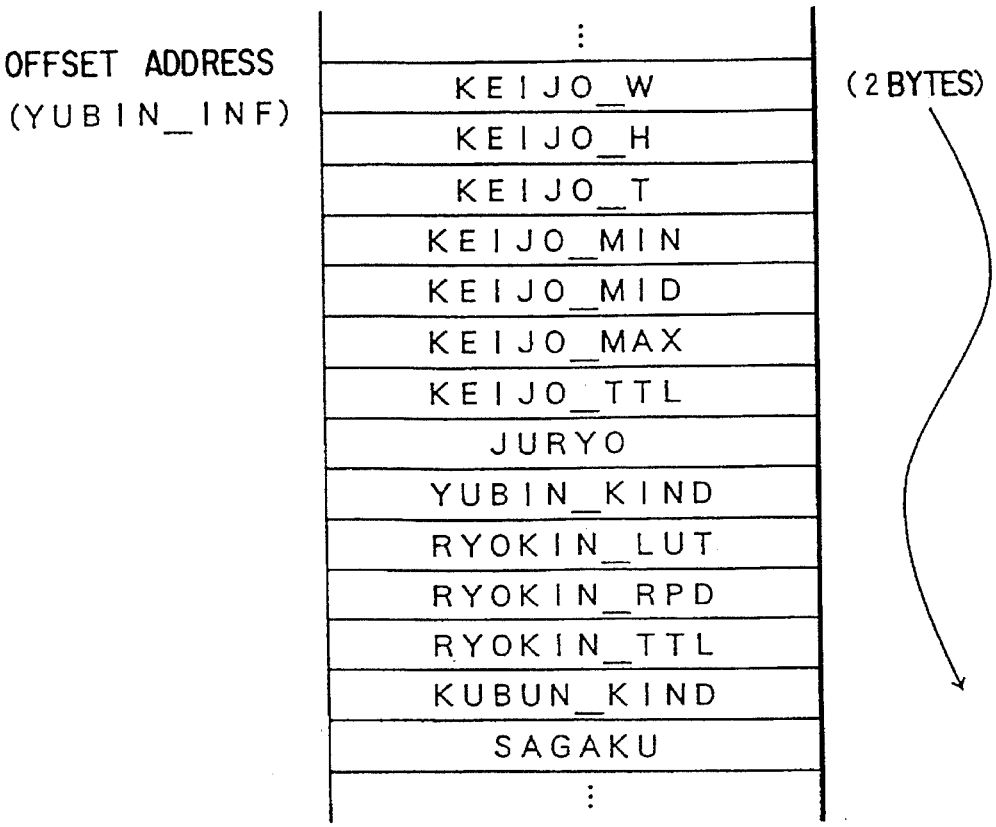
FIG. 19 shows a state in which data is stored in a temporary memory section.

A width measuring process stored in the program storage section 114 will be described by referring to FIG. 6. To detect that a piece of mail passes through the size sensor 104, the size read signal 405 is generated to access the width detection buffer 404 (S601). A check is made to see if there is a logic "0" signal indicating that a piece of mail has been sensed (S602) at the input of the buffer 404. If there is no logic "0" signal, the width sensing buffer 404 is accessed. If there are more than one logic "0" signal, the mail will be allowed to enter the shape sensor to some extent (S603), and then the width detection buffer 404 is accessed again to determine the number m of sensors with logic "0" (S604). On the basis of the value of m, the distance between sensors, the sensor installation positions, etc, the width KEIJO_W of the piece of mail is determined (S605), and the determined value is stored in the temporary memory section 115. How the sizes of and other information items on mail are stored in the temporary memory section 115 as shown in FIG. 19. Various types of information items are stored in units of two bytes, starting at the offset address (YUBIN_INF) in the memory.

Then, the contents of the width detection buffer 404 is read (S606). While sensors remain present with logic "0" ("YES" at step S606), the process is repeated. After the sensors with logic "0" all disappear and it is verified that the piece of mail has passed in front of the size sensor 104 completely (S607), the process is terminated.

The outputs of the comparator 403 and the other comparators are supplied to a NAND circuit 406, the output signal PENA 408 of which is connected to the enable terminal of a length counter 407. The clock terminal of the length counter 407 is supplied with an LSYNC 409 that becomes logic "1" each time the piece of mail advances 1 mm. The counter 407 counts up as long as a PENA signal 408 is "1." The counter output CNT 410 is supplied to the length detection buffer 411.

A count-up timing chart is shown in FIG. 5. After the CPU 113 has verified that all the signals to the width sensing buffer 404 are "1" and the piece of mail has passed through the size sensor 104, CPU 113 outputs a count read signal 412 to read in the value of the CNT 410, thereby storing the length of the piece of mail KEIJO_H at a specific address in the temporary memory section 115. In the embodiment, the value of CNT 410 corresponds to the length of the piece of mail in millimeters. Finally, the CPU 113 supplies a counter rest signal 413 to the length measuring counter 407 to clear the counter 407.

For the weight sensor 105, a measuring instrument for converting weight into an electric signal such as a gauge load converter can be used.

Figure 7:
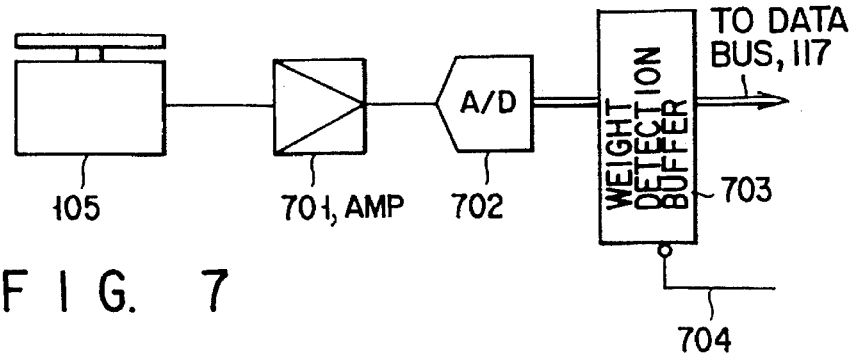
FIG. 7 is a circuit block diagram of a weight sensing section.

FIG. 7 is a block diagram of the weight detection section. The weight sensor 105 produces a voltage in proportion to the total weight of the pieces of mail placed in the mail feeder 201. After the voltage has been amplified by an amplifier 701, it is converted into a digital signal by an A/D converter 702, the output of which is connected to a weight detection buffer 703.

Figure 8:
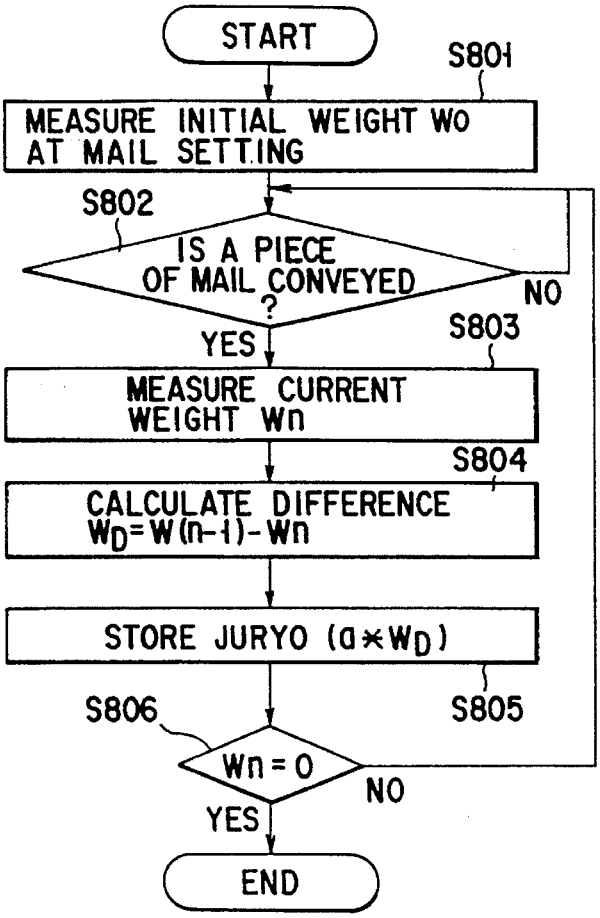
FIG. 8 is a flowchart for a mail weight measuring process.

A weight measuring process stored in the program storage section 114 will be described with reference to FIG. 8. With pieces of mail to be processed at a time placed in the mail feeder 201, a weight read signal 704 from CPU 113 is used to read the value of the weight detection buffer 703 to measure the initial weight $W_0$ (S801). After the mail position detector 125 etc. have detected that a piece of mail has been conveyed ("Yes" in step S802), the weight (Wn) of the remaining pieces of mail is measured (S803). Otherwise, while "NO" is obtained at S802, step S802 is repeated until a piece of mail has been conveyed. The difference $W_D$ between this weight and the previously measured weight (Wn−1) is computed (S804). After the difference $W_D$ is multiplied by constant "a" to convert it into grams, the resulting value is stored as JURYO at a specific address in the temporary memory section 115 (S805). The above calculation is repeated until $W_D$ is zero, or the mail feeder 201 is empty (S806).

Figure 9:
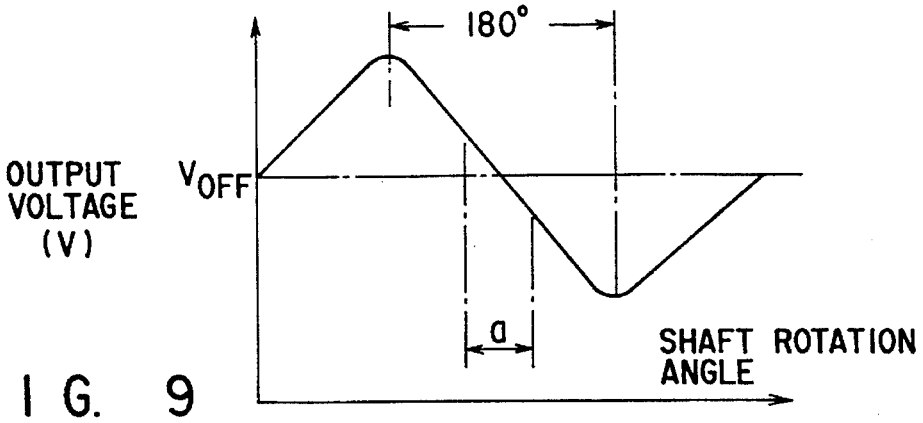
FIG. 9 is an output-voltage characteristic diagram of an angle sensor.

Finally, for the thickness sensor 106, an angle sensor using, for example, a magnetic reluctance element, can be used. The angle sensor is a sensor for converting the rotational angle of a shaft into a voltage. Its output characteristics are shown in FIG. 9. FIG. 9 has the shaft rotational angle on the abscissa and the output voltage on the ordinate, wherein the voltage increases and decreases with the shaft rotation angle, centered at the offset voltage $V_{OFF}$. Since there is a proportional relationship between angles and voltages, particularly in an angle area "a" near $V_{OFF}$, this area "a" is usually used as a thickness sensing area.

Figure 10:
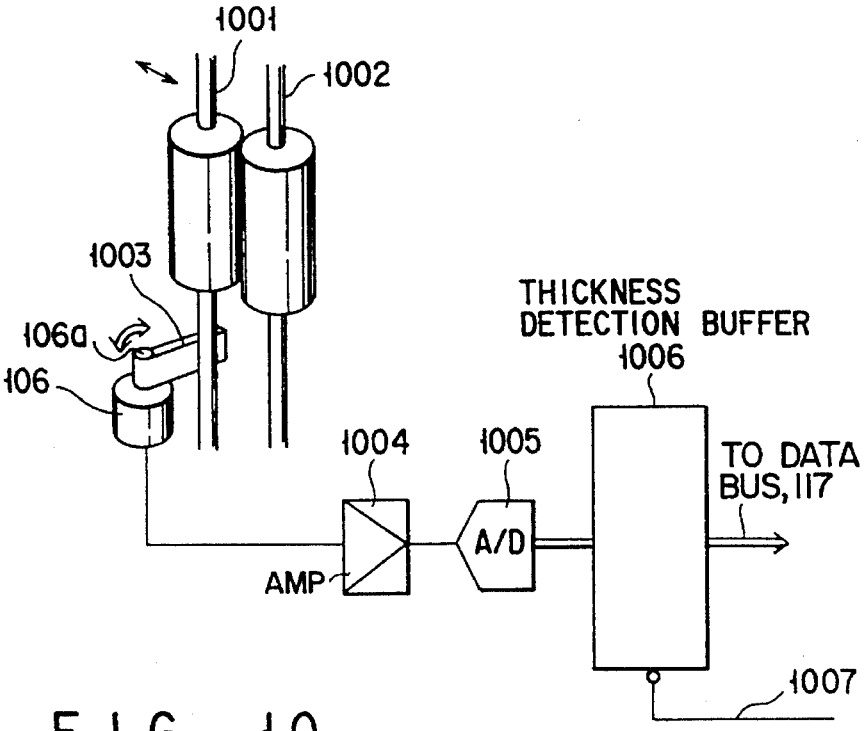
FIG. 10 is a circuit block diagram of a thickness sensing section.

FIG. 10 is a block diagram of the thickness detection section. In the figure, two rollers 1001, 1002 are placed so as to face each other with a transport path between them. The roller 1001 is a movable roller which is urged by a spring (not shown) to the roller 1002 and moves in the dark arrow direction when a piece of mail passes. The other is a fixed roller 1002. In this case, the movement of the movable roller 1001 corresponds to the thickness of a piece of mail. A free end of a leaf spring 1003 abuts on an axis of the roller 1001 and converts the movement of the movable roller 1001 into a rotational angle of a shaft **106*a* of the sensor 106, which is transmitted to the thickness sensor 106 acting as an angle sensor. The thickness sensor 106 produces a voltage proportional to the thickness of a piece of mail. After the voltage is amplified by an amplifier 1004, it is converted into a digital signal by an A/D converter 1005, the output of which is connected to a thickness detection buffer 1006**.

Figure 11:
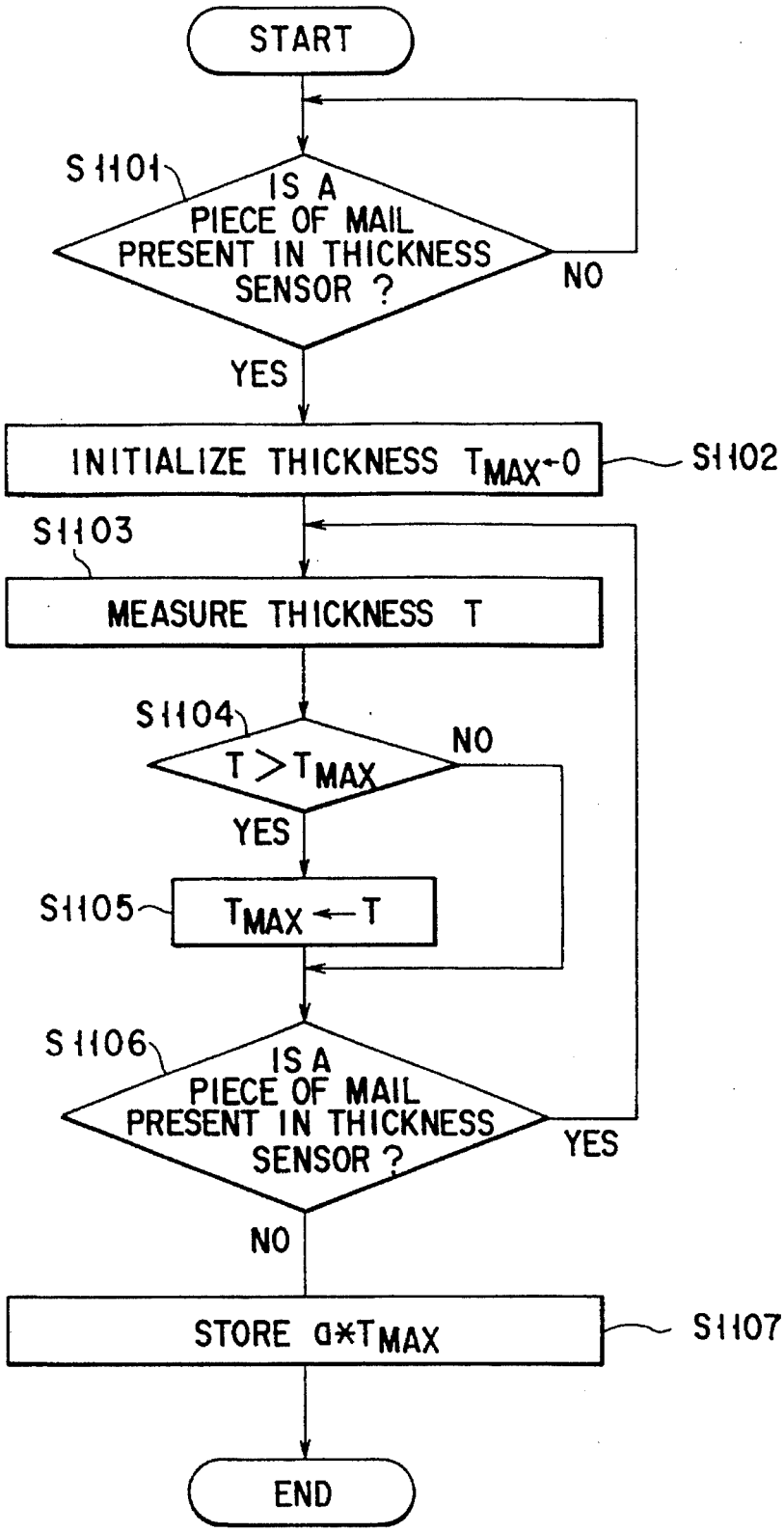
FIG. 11 is a flowchart for a mail thickness measuring process.

A thickness measuring process stored in the program storage section 114 will be described with reference to FIG. 11. After the mail position detection sensor 125 etc. have detected that a piece of mail is passing through the thickness sensor 106 ("Yes" obtained in step S1101), the maximum value $T_{MAX}$ of the thickness is initialized (S1102). Otherwise, the process repeats until a piece of mail is detected (while "NO" is obtained at step S1101). Then, a thickness read signal 1007 is supplied from CPU 113 to read the value of the thickness detection buffer 1006 to measure thickness T (S1103). When comparison of thickness T with the maximum value $T_{MAX}$ (S1104) shows that the former is larger than the latter, the maximum value is replaced with T (S1105). The process returns to step S1103 while the piece of mail is present ("YES" at step S1106). After the mail position detection sensor 125 etc. have sensed that the piece of mail has exited the thickness sensor 106 ("NO" obtained in step S1106), the maximum value $T_{MAX}$ is multiplied by a constant "a" to convert it into millimeters and then the thickness of the piece of mail KEIJO_T is stored at a specific address in the temporary memory section 115 (S1107).

The image data generating section will be explained. CCD sensors widely used as the input device for an image input unit are available as two-dimensional area sensors and one-dimensional line sensors. When an object or a piece of mail to be read is being transported, a two-dimensional image can be formed with a one-dimensional line sensor.

Figure 12:
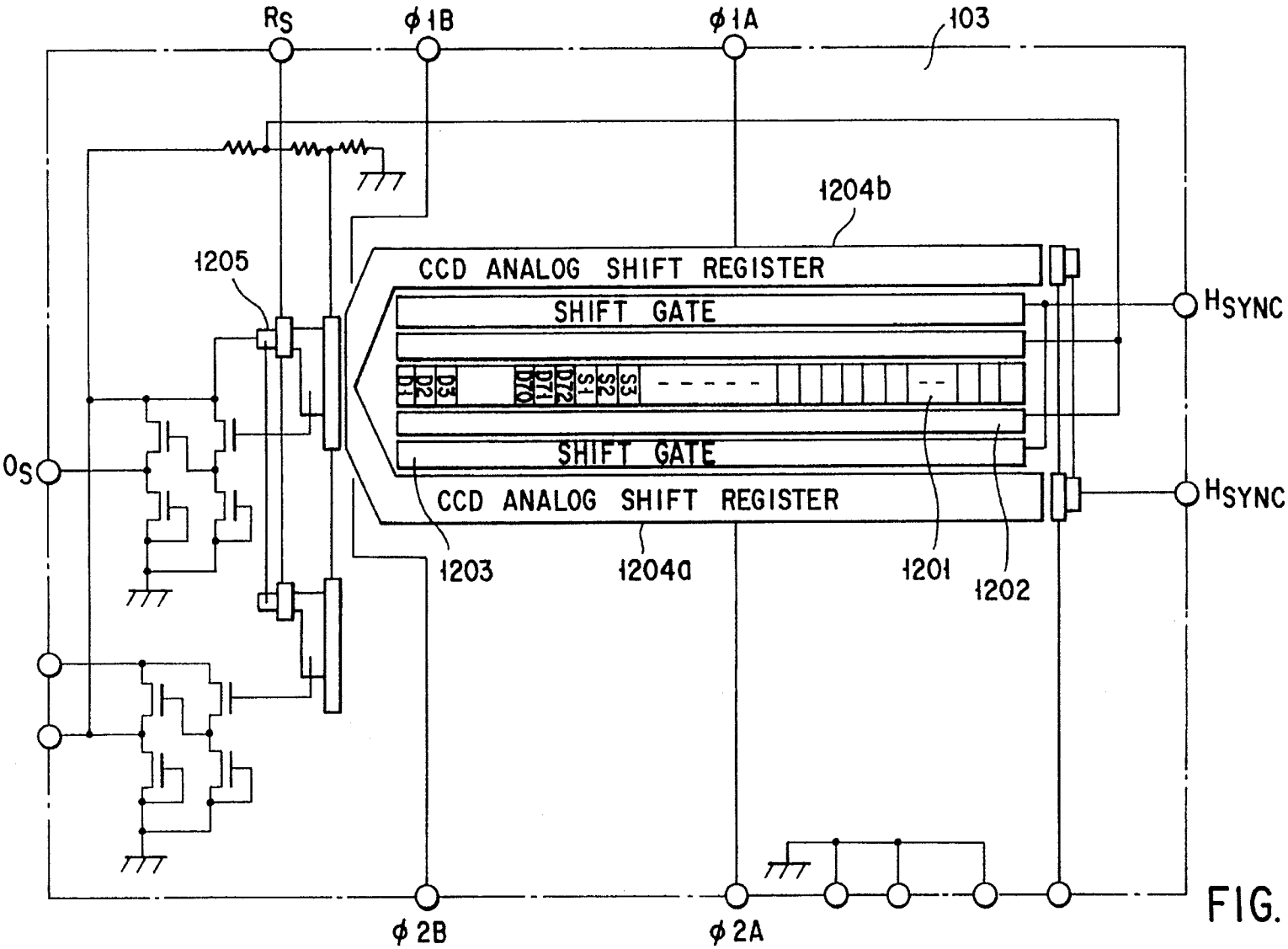
FIG. 12 is a block diagram of a line sensor.
Figure 13:
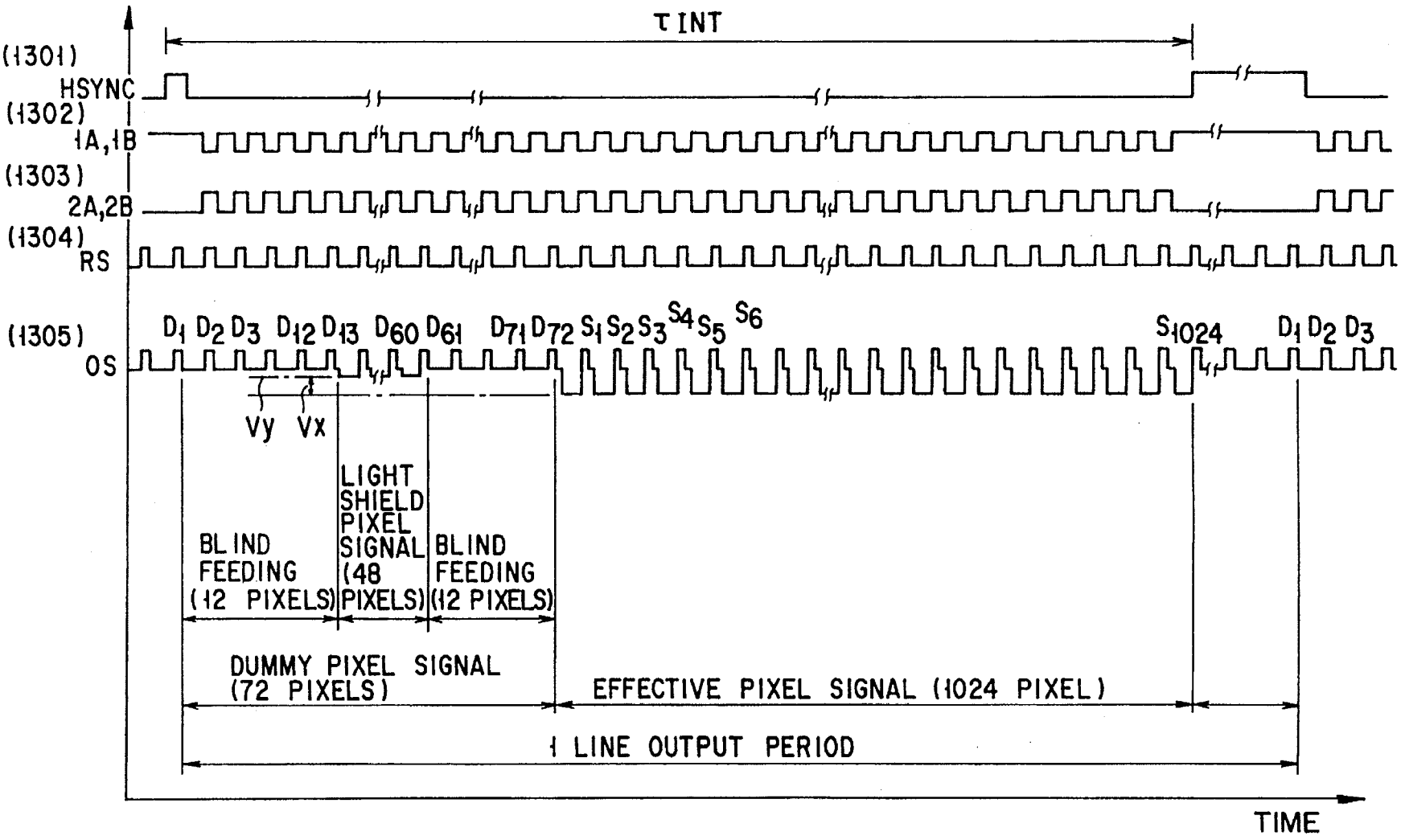
FIG. 13 is a timing chart to explain the operation of the line sensor.

FIG. 12 shows the structure of a line sensor, an example of the optical read sensor 103. In the center of the line sensor, there is a photodiode array 1201 composed of a photoelectric transducer. On either side of the array, a storage electrode 1202, a shift gate 1203, and a CCD analog shift register **1204*a* are placed. The shift gate 1203 is supplied with the HSYNC signal 1301 shown in the timing chart of FIG. 13. This signal is used to transfer the charges accumulated in a photodiode array 1201 during one-line read time τINT to CCD analog shift registers 1204*a* (odd-numbered pixels) and 1204*b* (even-numbered pixels). After the charges have been transferred through two routes to an output gate 1205 with driving clocks φ1A, φ1B (1302) and φ2A, φ2B (1303), the charge is initialized pixel by pixel with reset clock RS (1304) and undergoes charge-to-voltage conversion, and the resulting voltage (1309) is supplied from an OS terminal to an outside circuit. In the case of this sensor, the number of effective pixels is 1024. In front of the effective pixels, there are 72 dummy pixels D1 to D72, of which 48 pixels are light shielding pixels for clamping the off-set voltage of the sensor and start and end 12** pixels are blind feeding pixels.

Figure 14:
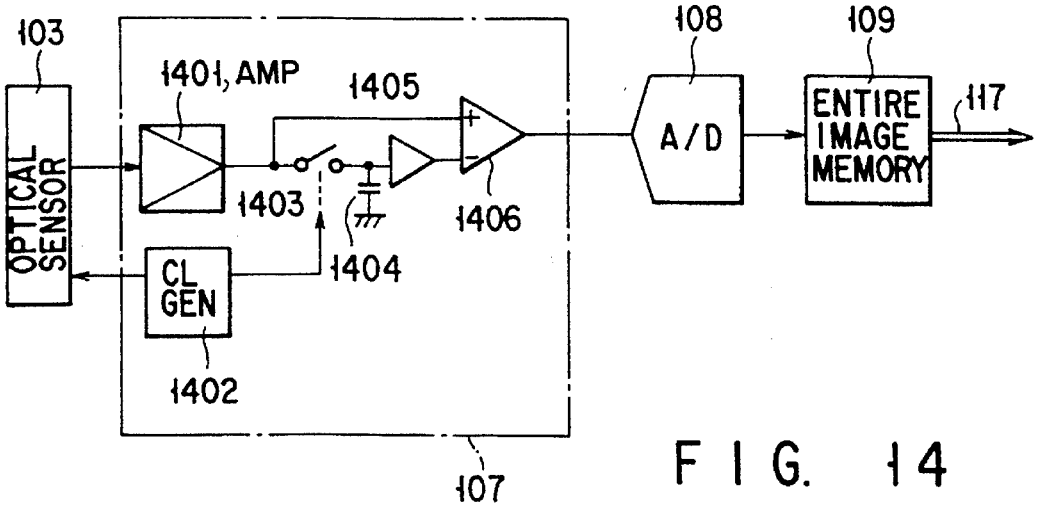
FIG. 14 is a block diagram of an image data generating section.

FIG. 14 is a functional block of the image data generating section. The driving clock for the optical read sensor 103 is generated at a clock generator circuit 1402 in the analog signal processing section 107. After the output signal of the optical read sensor 103 is stabilized in signal level at a sample/hold circuit 1401, it is supplied to the noninverting input of a differential amplifier 1406 and a switch circuit 1403. The switch circuit 1403 turns on only in the light shielding portion of the CCD image signal, and charges the voltage during that time in a capacitor 1404. Because the voltage 1405 is applied to the noninverting input of the differential amplifier 1406, only the effective alternating-current component from which the offset voltage of the CCD signal has been removed is extracted and supplied to the A/D converting section 108 in the next stage. The A/D converting section has the function of converting an analog signal into a digital signal. For this purpose, an 8- to 10-bit A/D converter is usually used. The mail image data converted into a digital signal is stored in the entire image memory 109.

Figure 15:
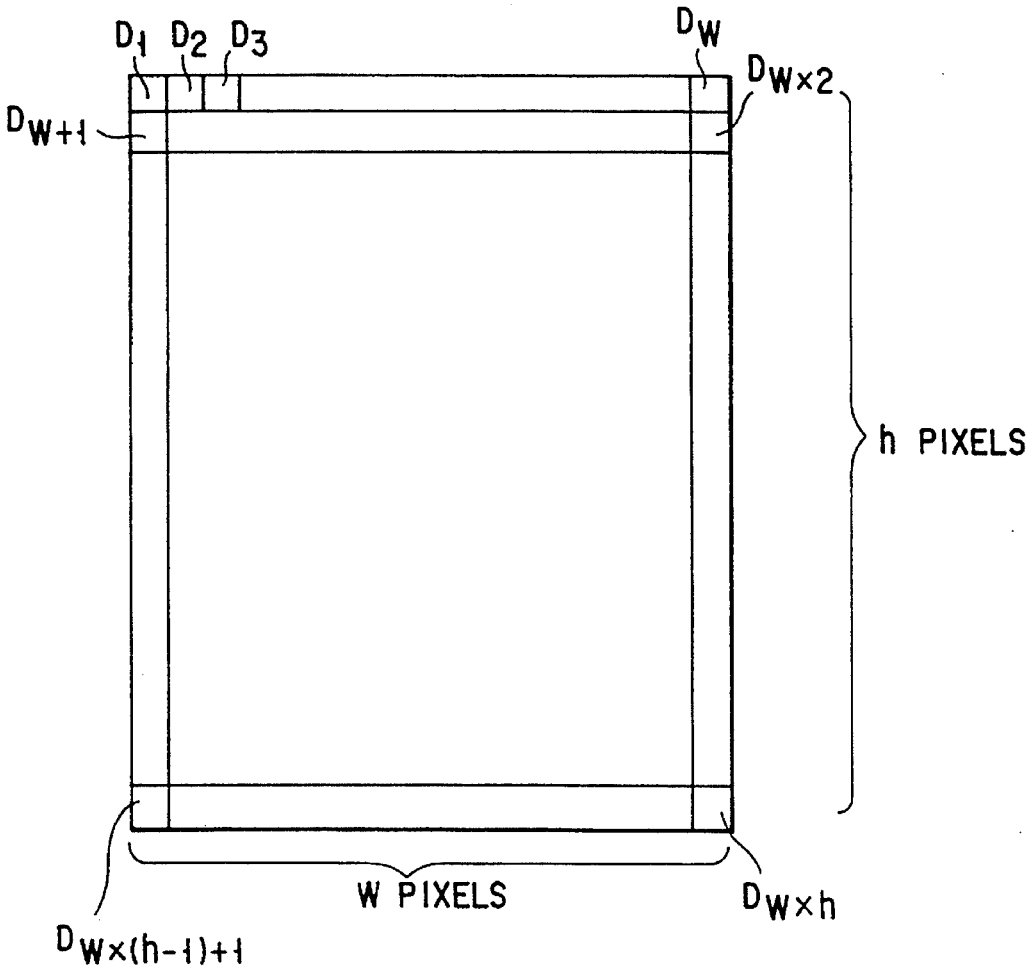
FIG. 15 shows the pixel arrangement of the overall image memory.
Figure 16:
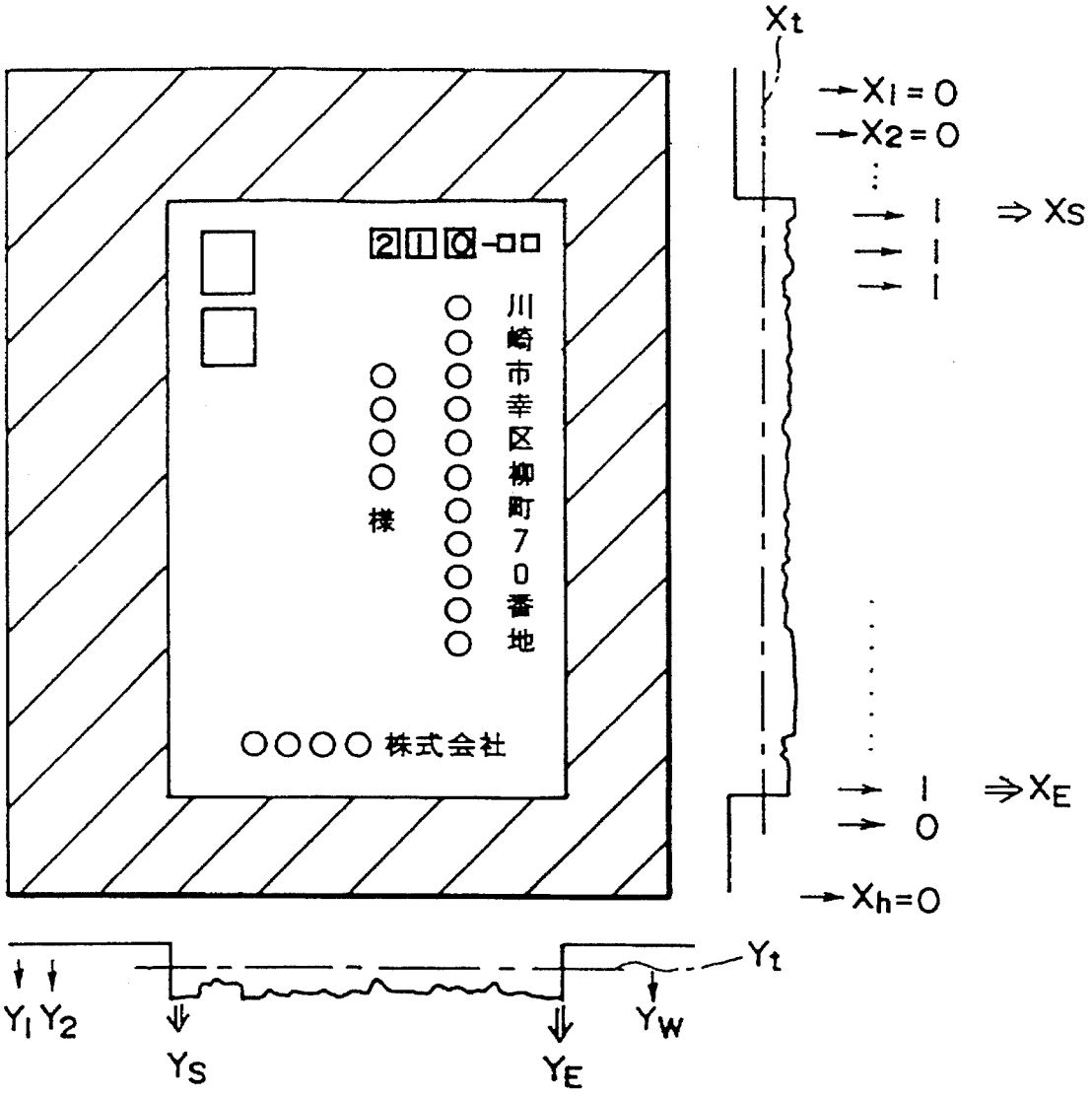
FIG. 16 shows the entire image data on mail stored in the overall image memory.

Using FIGS. 15 to 18, a mail image extracting process stored in the program storage section 114 will be explained. FIG. 15 shows an image of the entire image memory 109, which is composed of w pixels in the horizontal direction and h pixels in the vertical direction. Data D1 on the top left pixel is stored at the start address in the memory. To the right, w pixels are arranged consecutively in the lateral direction. Following the last pixel Dw in a first low, a first pixel Dw+1 in a second row is arranged. Pixel Dw*h at the bottom right is written at the end address in the entire image memory 109. FIG. 16 shows an image of a piece of mail written on the memory. Reading is effected by the optical read sensor 103 with a dark background to make the background image of the mail dark. The hatched portion in the figure indicates the dark image.

Figure 17:
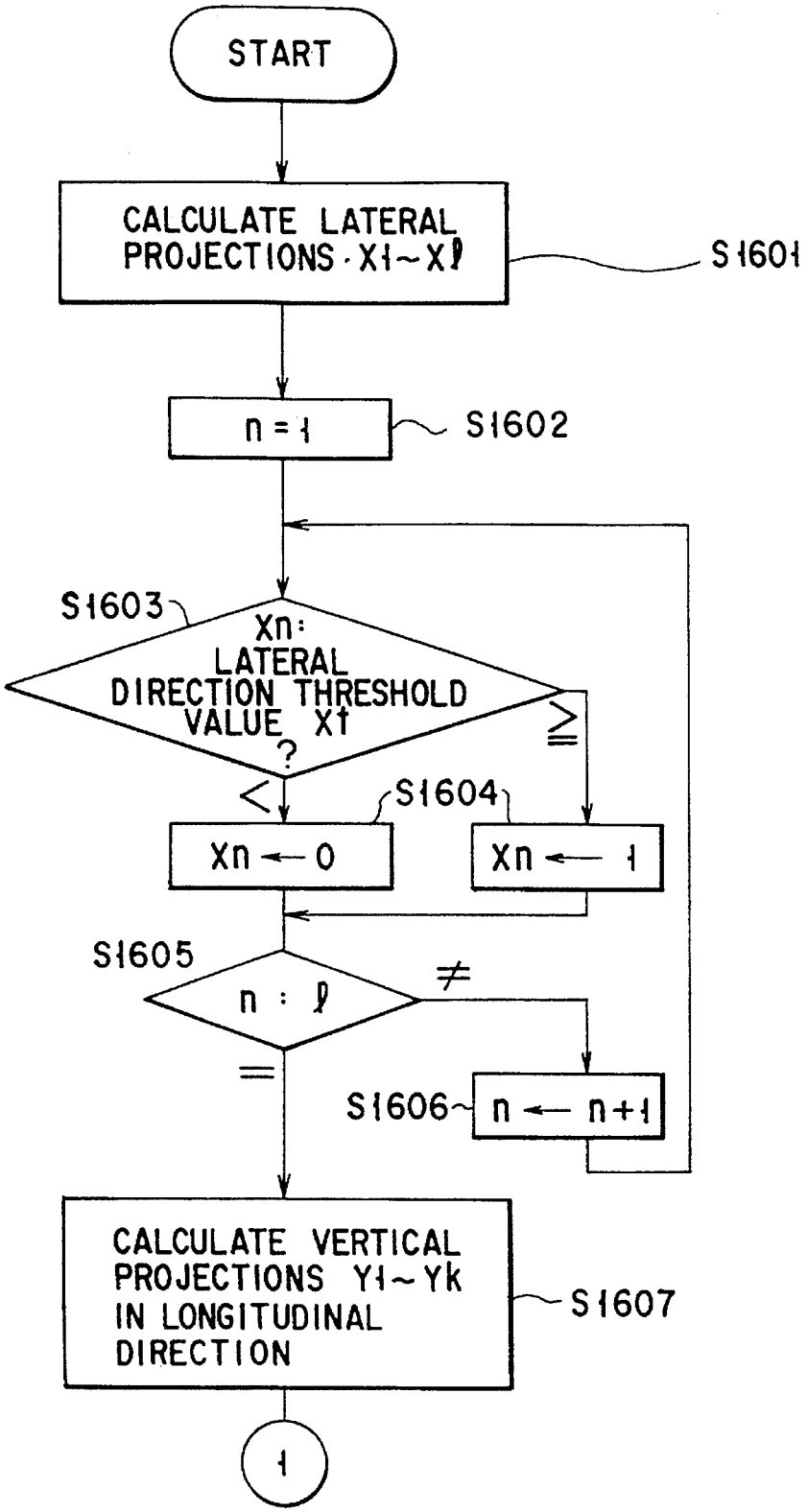
FIG. 17 is a flowchart for processing mail image data.
Figure 18:
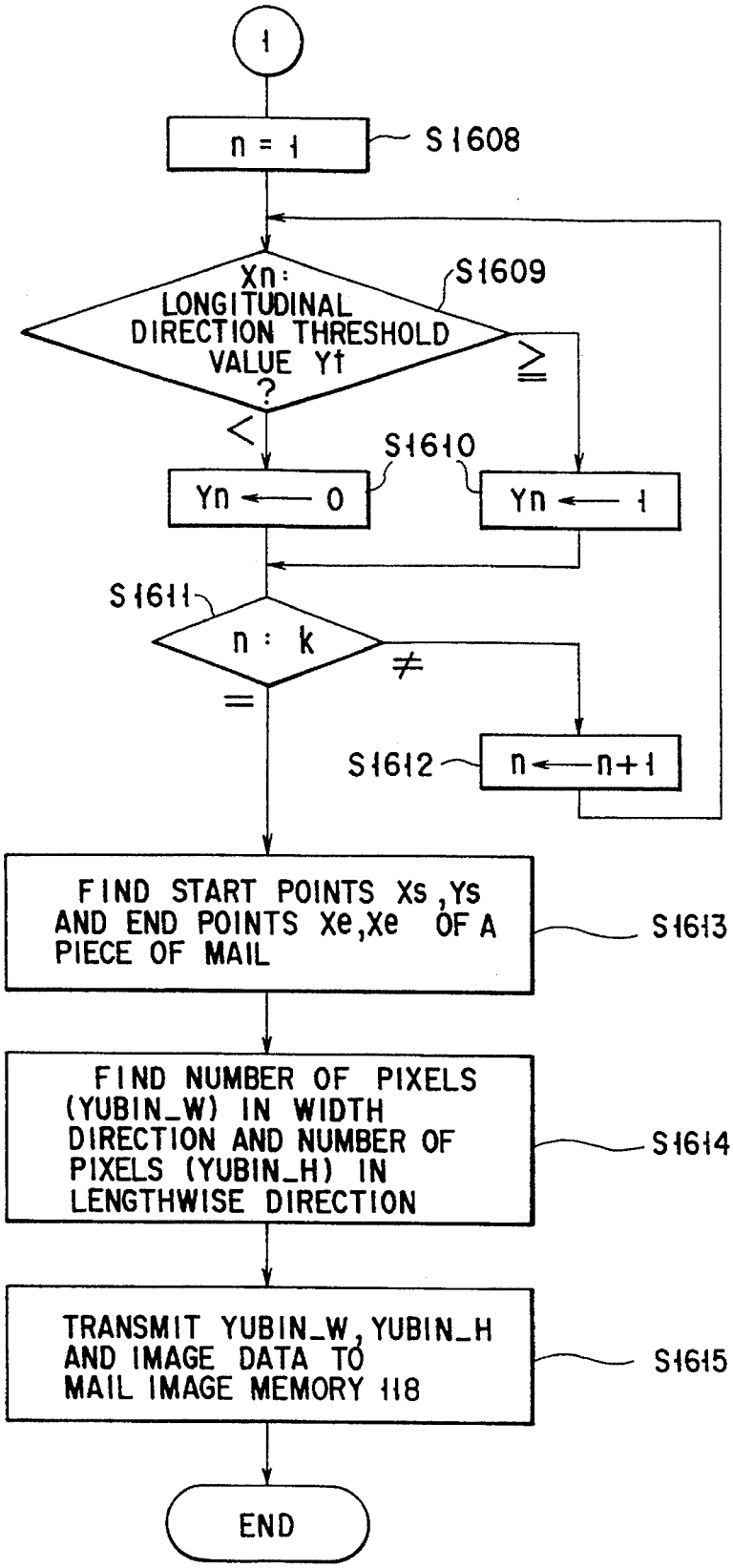
FIG. 18 is a flowchart for processing mail image data.

The process of removing the background dark portion from the image will be explained, referring to FIGS. 17 and 18. The projection is computed line by line in the lateral direction of the entire image memory 109 (S1601). The projection is obtained by simple addition of w pixels. Next, projection value Xn in n-th row is compared with threshold value Xt in the lateral direction, then binarization is effected as follows: when $Xn<Xt$, $Xn=0$, and when $Xn \geqq Xt$, $X=1$ (S1603, S1604). After the same process has been carried out for one line (S1605, S1606), the same projection process is also performed in the vertical or longitudinal direction (S1607 to S1612). Since it can be judged that the area where the binarized projection value is "1" is the range where a piece of mail exists, the starting point (Xs, Ys) of the "1" area and its end point (Xe, Ye) are calculated in either direction (S1613), and then the number of pixels in the width direction YUBIN_W=Xe−Xs+1 and the number of pixels in the longitudinal direction YUBIN_H=Ye−Ys+1 are obtained (S1614). The YUBIN_W and YUBIN_H and the image in the area are transferred to the mail image memory 118 in the image data storage section (S1614).

Figure 20:
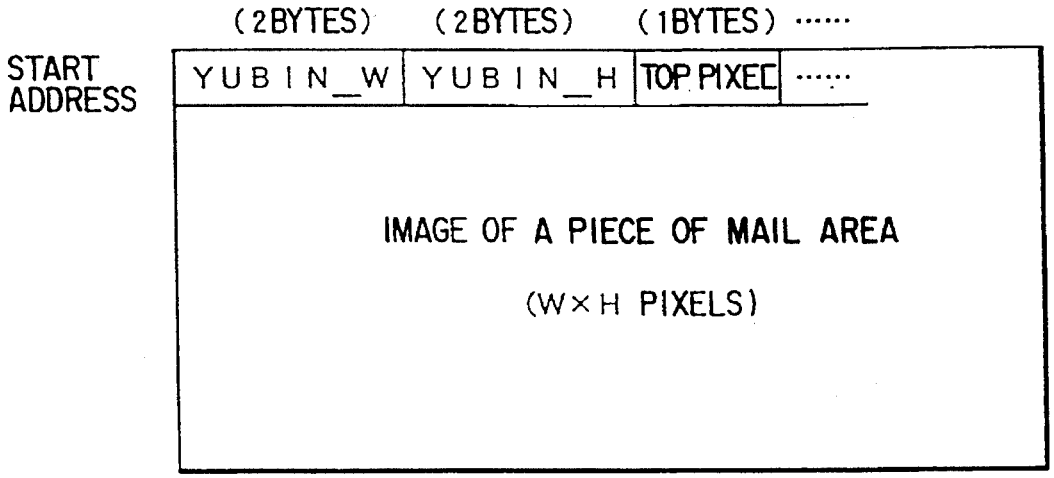
FIG. 20 shows a state in which data is stored in a mail image memory.

How the image data is stored in the mail image memory 118 is shown in FIG. 20. The data YUBIN_W for width is stored in two bytes from the start address, the YUBIN_H for length is stored in the next two bytes, and the image in the mail area (W×H pixels) is stored in a fifth byte and later.

While in the physical quantity detection section, the width and length of a piece of mail are measured using the size sensor 104 and the size detection section 110, the size may be determined from the above YUBIN_W and YUBIN_H data. That is, the value obtained by converting YUBIN_W into millimeters represents the width and that obtained by converting YUBIN_H into millimeters indicates the length.

Using the information processing section and the image data storage section, the process of computing the postage of the postal indicia from the mail image stored in the mail image memory 118 will be explained.

Figure 21A:
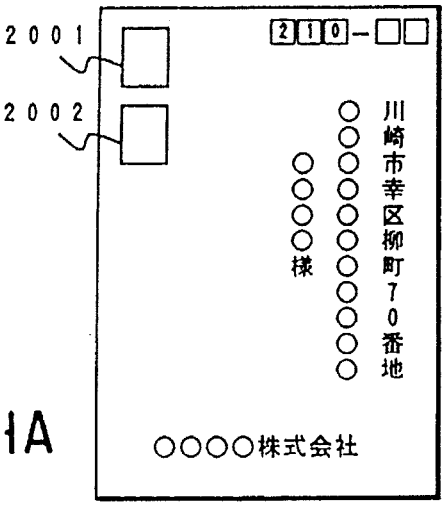
FIGS. 21A to 21E show various examples of postcard with various types of postal indicia.
Figure 21B:
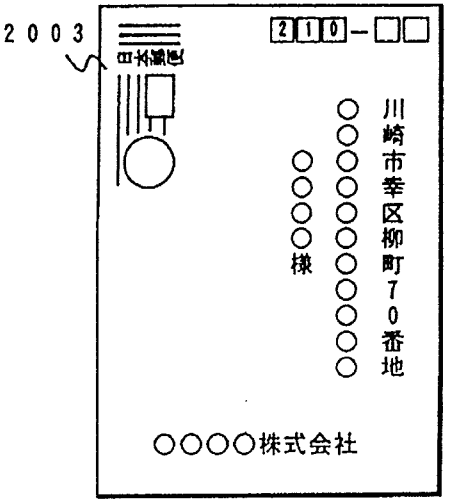
Figure 21C:
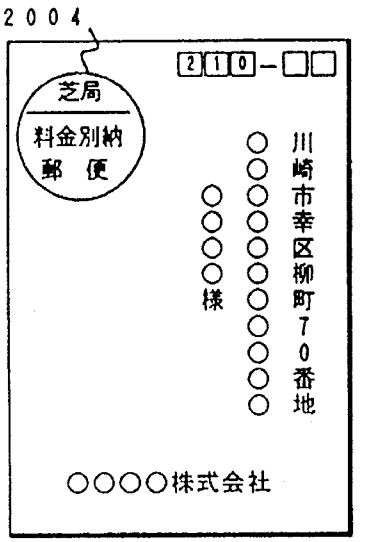
Figure 21D:
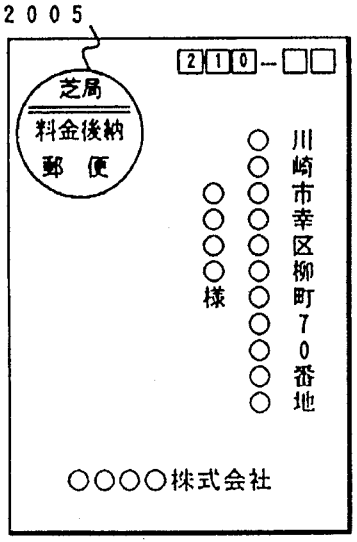
Figure 21E:
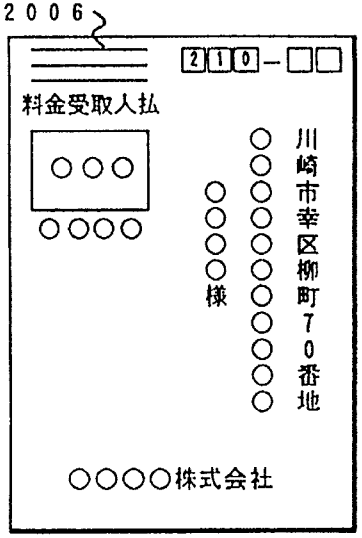

Postal indicia include the postal indicia of postage stamp or government-printed post-card as shown in areas 2001, 2002 in FIG. 21A, a postage meter impression as shown by 2003 in FIG. 21B, a separately paid impression as shown by 2004 in FIG. 21C, a postpaid impression as shown by 2005 in FIG. 21D, and a collect impression as shown by 2006 in FIG. 21E. Information indicating the types or kinds of such postal indicia is defined as follows under INMEN_KIND:

| Kind of postal indicia | INMEN_KIND |
|---|---|
| Not postal indicia | 0 |
| Postage stamp | 1 |
| Postage meter impression | 2 |
| Separately paid impression | 3 |
| Postpaid impression | 4 |
| Collect impression | 5 |
| Other postal indicia | 6 |

Figure 22:
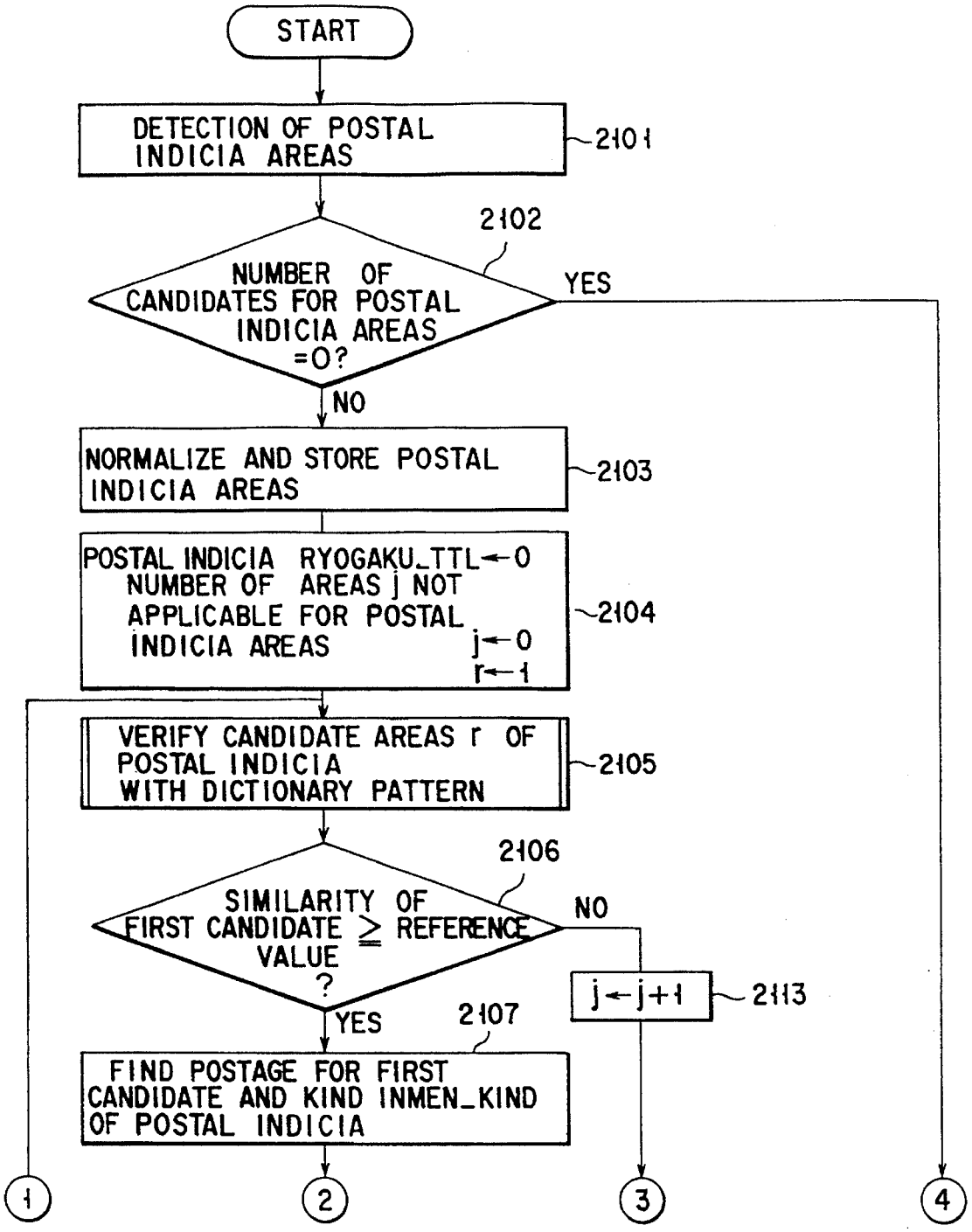
FIG. 22 is a flowchart for detecting the postage on the postal indicia from a mail image.
Figure 23:
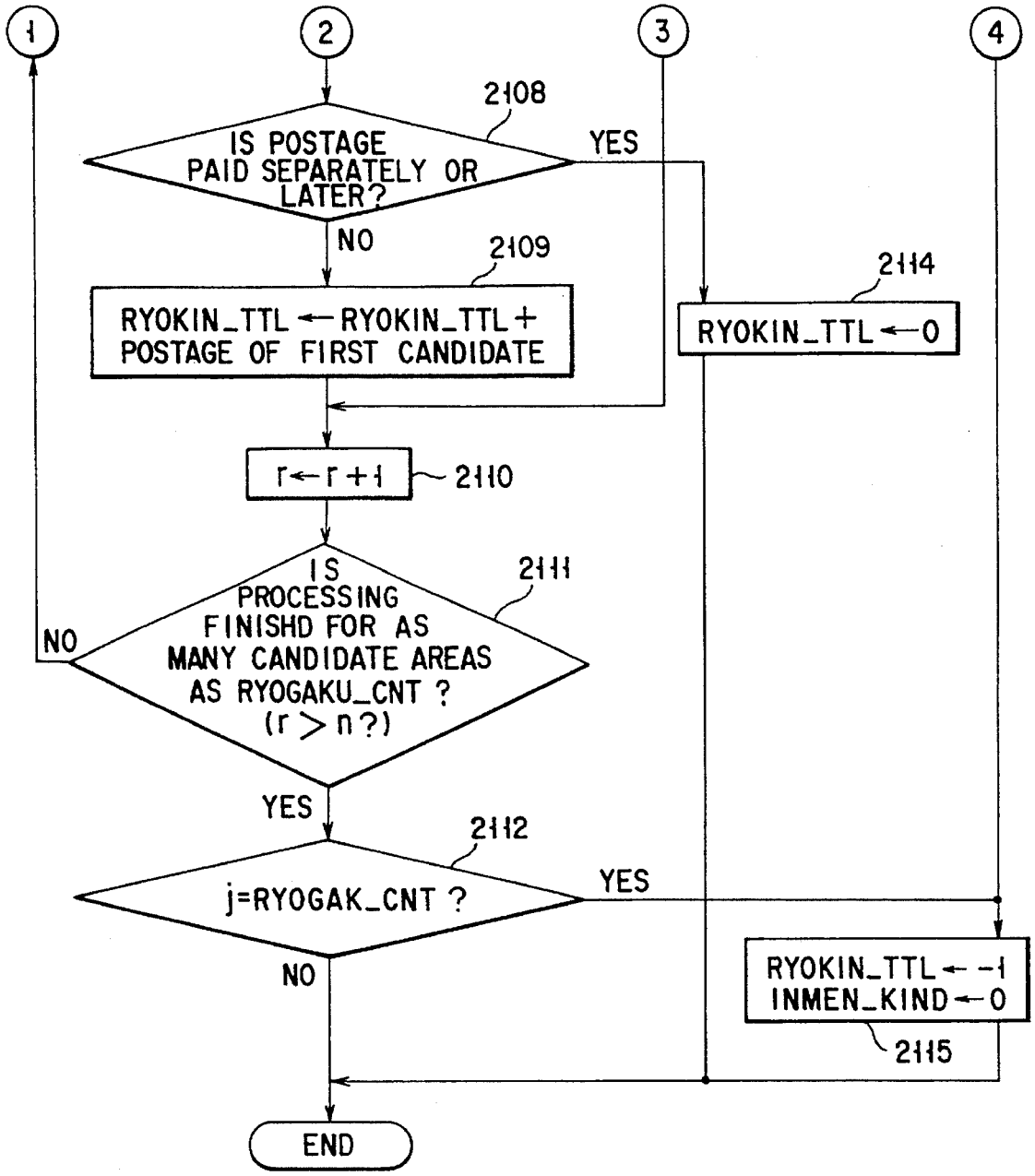
FIG. 23 is a flowchart for detecting the postage on the postal indicia from a mail image.

To detect the above postal indicia and compute the postage from a postage stamp or a meter impression, the processing procedures as shown in FIGS. 22 and 23 are stored in the program storage section 114.

A postal indicia candidate area is detected from the mail image stored in the mail image memory 118 according to the processing procedures for detecting a plurality of postal indicia (S2101).

Figure 24:
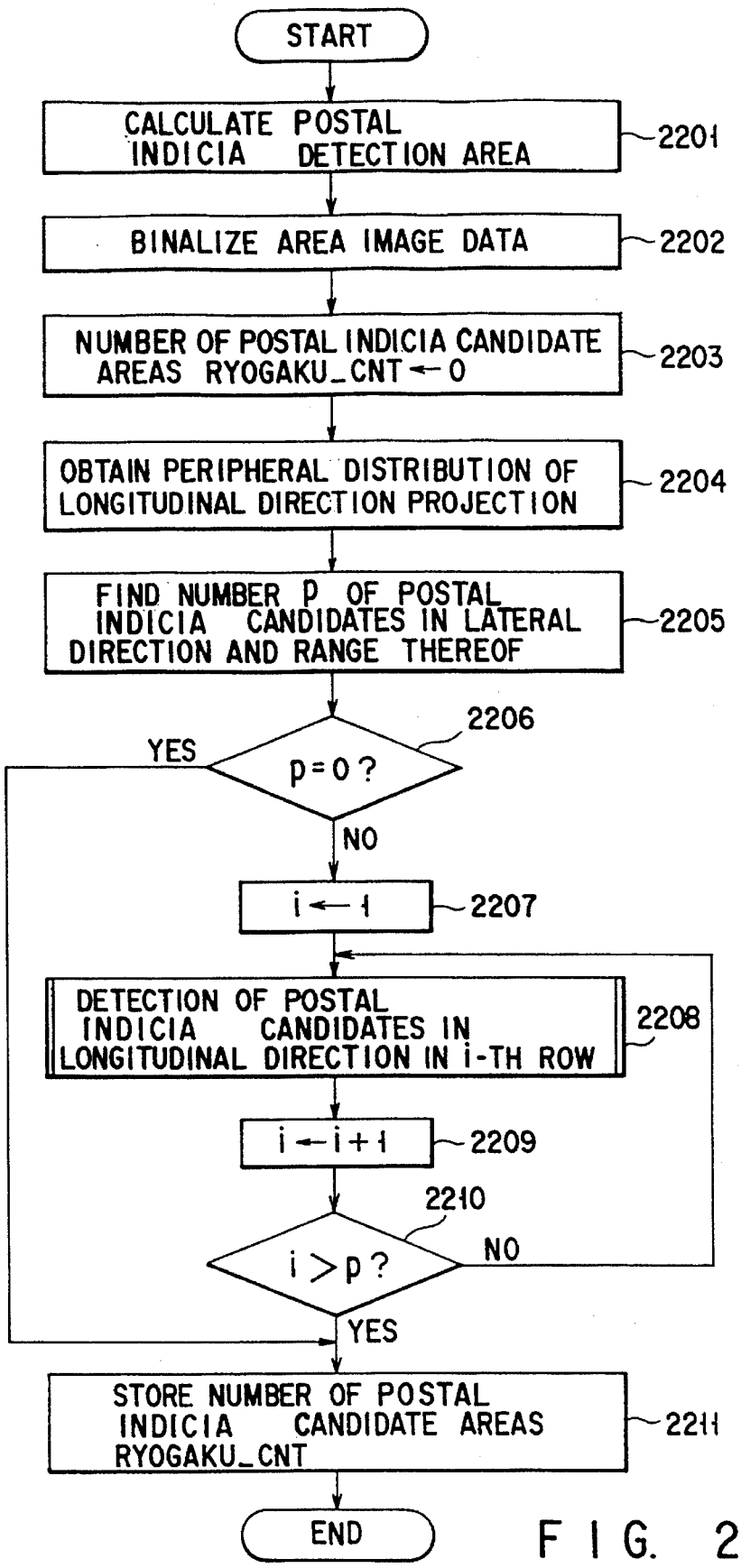
FIG. 24 is a flowchart for detecting the postal indicia area from a mail image.

This detection means is composed of the processing procedure as shown in FIG. 24. The CPU 113 reads out the number of pixels in the lateral direction of mail YUBIN_W data stored in the two-byte area beginning with the start address in the mail image memory 118, and the number of pixels in the longitudinal direction of mail YUBIN_H data stored in the next two-byte area and determines a postal indicia detecting area such as the shaded area in FIG. 26 which has W pixels in the lateral direction and H pixels in the longitudinal direction, beginning with the top left pixel, determined by the lateral and the longitudinal length, YUBIN_W and YUBIN_H, respectively (S2201). A method of computing the number of pixels in the lateral direction W and the number of pixels in the longitudinal direction H of the postal indicia detecting area is to determine the number of pixels in the lateral direction W and the number of pixels in the longitudinal direction H of the postal indicia detecting area so that W and H may have constant reduction rates of 1/Rw and 1/Rh with respect to the number of pixels in the lateral direction YUBIN_W and the number of pixels in the longitudinal direction YUBIN_H, respectively.

$$W=YUBIN_W/Rw,\ H=YUBIN_H/Rh$$

For example, if Rw=4, Rh=4, the postal indicia detecting area with the number of pixels in the lateral direction W and the number of pixels in the longitudinal direction H, beginning with the top left has an area of 1/16 the mail image area.

Of the mail image stored starting at the fifth byte in the mail image memory 118, the image data in the postal indicia detecting area detected at step 2201 is binarized with, for example, a threshold value of 128 (THR), and the result is stored in the temporary memory section 115 (S2202). After the total number of postal indicia candidate areas RYOGAKU_CNT is set to 0 (S2203), pixels related to the postal indicia image, for example, dark pixels, are totalized in the longitudinal direction with respect to the binarized image in the postal indicia area stored in the temporary memory section 115, and the peripheral distribution as shown in FIG. 27 is obtained (S2204). From the peripheral distribution, concatenating ranges where the totalized data is not 0 and whose length is a reference concatenating length Wstd or more (e.g., 10 pixels or more) are obtained in sequence. Those concatenating ranges are determined to be lateral postal indicia candidate ranges. The total number p of lateral postal indicia candidate ranges, and the start and the end position of each range xs(i), xe(i) [i=1, 2, . . . , p] are obtained (S2205). At this time, if no concatenating range where the accumulated data is not 0 is the reference concatenating length Wstd or more, the total number p of lateral postal indicia candidate ranges will be 0. Next, a check is made to see if the total number p of lateral postal indicia candidate ranges is 0 (S2206). If it is 0, the total number of postal indicia candidate areas RYOGAKU_CNT (=0) is stored in the two-byte area beginning with the start address in the postal indicia image 119 (S2211). Then, the process at step S2101 in FIG. 22 is terminated.

If the total number p of lateral postal indicia candidate ranges is not 0, a postal indicia candidate area is obtained from the first column candidate area determined by the lateral start position xs(1) and end position xe(1) and the longitudinal start and end positions of the postal indicia detecting range (S2208).

Figure 25:
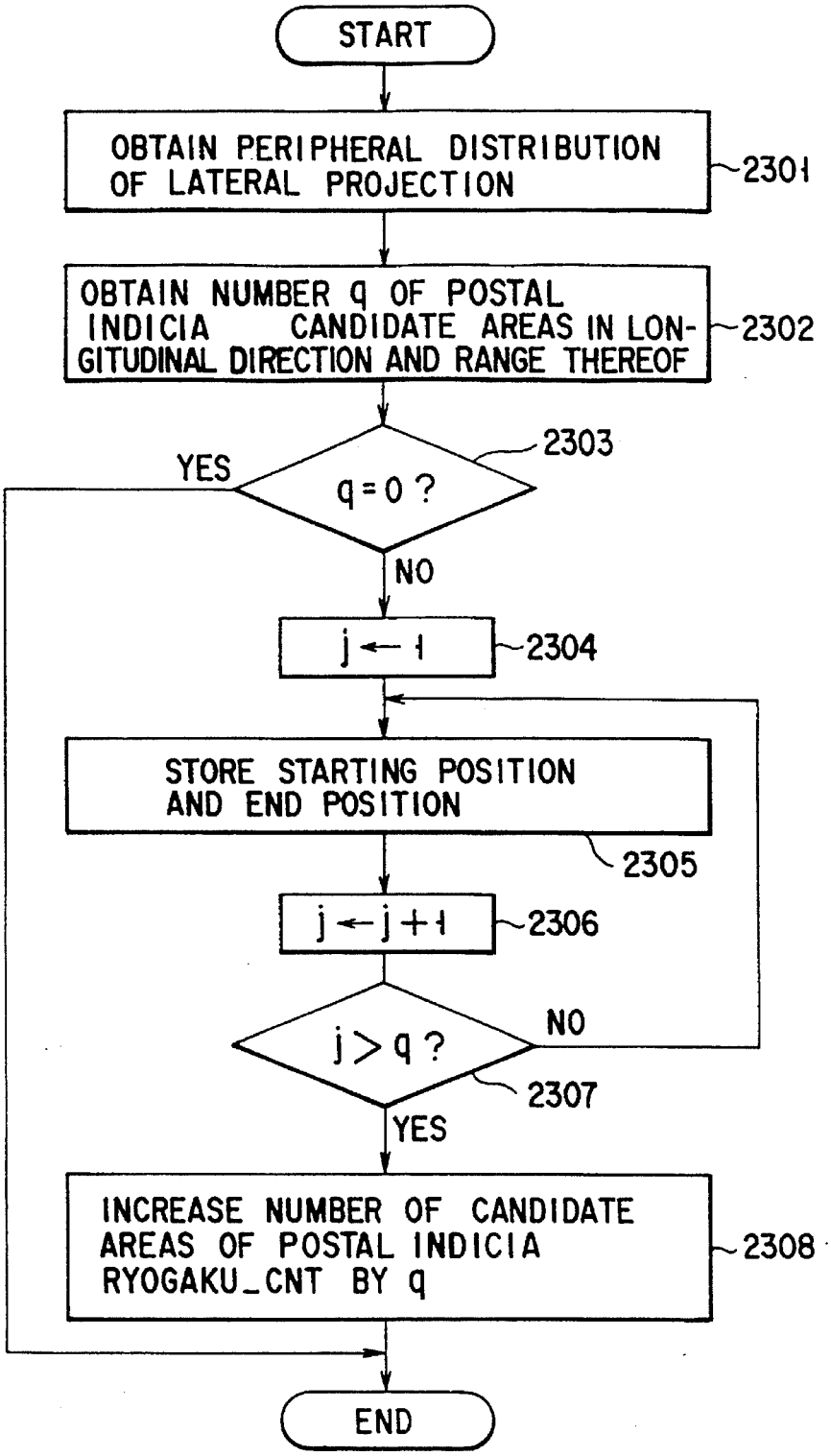
FIG. 25 is a flowchart for determining the postal indicia candidate.

This detection means is composed of, for example, the processing procedure as shown in FIG. 25. Pixels related to the postal indicia image, for example, dark pixels are accumulated in the lateral direction with respect to the binarized image in the first column candidate area, and the peripheral distribution as shown in FIG. 28 is obtained (S2301). From the peripheral distribution, data concatenating ranges where the accumulated data is not 0 and whose length is the reference concatenating length Hstd or more (e.g., 10 pixels or more) are obtained in sequence. The total number q of those concatenating ranges, and the start and the stop position of each range ys(j), ye(j) [j=1, 2, . . . , q] are determined (S2302). If the total number q of concatenating ranges is 0 ("Yes" at step 2303), the process at step S2208 will be terminated. If the total number q of concatenating ranges is not 0 ("NO" at step 2303), the program proceeds to step 2304 where a counter j is initialized. Next, the longitudinal start and end positions ys(i), ye(j) obtained at step S2302 and the lateral start and end positions xs(1), xe(1) of the first-column candidate area are stored in the temporary memory section 115 (step 2305), and the counter j is incremented (step 2306) and compared to the total q (step 2307). This process is repeated for all start and end positions (while "NO" is obtained at step 2307) until all positions are stored ("YES: is obtained at step 2307). Then, q is added to the total number of postal indicia candidate areas RYOGAKU_CNT (S2308).

The start and end positions of all postal indicia candidates in the candidate areas until the p-th column are obtained (step 2210) in a similar manner to the procedure for obtaining the start and end positions of the postal indicia candidate in the first-column candidate area, and the results have been stored in the temporary memory section 115 in sequence, by incrementing a counter i (step 2209) initialized in step 2207. Thereafter (when "YES" is obtained at step 2210), the total number of postal indicia candidate areas RYOGAKU_CNT is stored at the start address of the postal indicia image 119 (S2211). Then, the process at step 2101 in FIG. 22 is terminated.

After the postal indicia candidate area has been detected at step 2101, the program proceeds to step 2102 where the postal indicia image memory 119 is accessed to read the total number of postal indicia candidate areas RYOGAKU_CNT. If RYOGAKU_CNT is 0 ("Yes" at step 2102) it is judged that there is no postal indicia candidate area. Then, the program proceeds to step 2115 of FIG. 23 where the postage of the postal indicia RYOKIN_TTL is set to −1, the postal indicia type information INMEN_KIND is set to 0, and then the process is terminated. If RYOGAKU_CNT is larger than 0 ("NO" at step 2102) that is, if a postal indicia candidate area is present, the program proceeds to step 2103 where the start and end position information items on as many postal indicia candidate ranges as RYOGAKU_CNT stored in the temporary memory section 115 are read sequentially. The image data on the rectangular area of the mail image 118 determined by those two points is stored in the temporary memory section 115 in sequence. Each postal indicia candidate area is normalized to fit it into the M x N-pixel dictionary pattern. For example, to normalize an image f (x, y) in the postal indicia candidate area whose start and end positions are xss, xse, yss, and yse as shown in FIG. 29 to an M x N image g (x, y), the following conversion is effected:

$$g(x,y)=f\ (int((x-xss)*M/(xse-xss+1))$$

$$int((y=yss)*N/(yse-yss+1)))$$

where y=int (x) represents a function used to determine the maximum integer that does not exceed x.

The normalized result is stored in the postal indicia image memory 119. At this time, for example, the image data in the postal indicia candidate area 1 is stored in the M×N-byte area, beginning with the third byte at the start address in the postal indicia image memory 119 as shown in FIG. 30. Similarly, the images in as many postal indicia areas as RYOGAKU_CNT are stored in the postal indicia image memory 119.

Next, at step 2104, postage RYOKIN_TTL is initialized to 0. Then, j indicating the number of areas detected not to be postal indicia candidates as a result of collating with a dictionary pattern (explained below) concerning as many postal indicia candidate areas as RYOGKU_CNT, is initialized to 0. Thereafter, the image data in the M×N postal indicia candidate area 1 stored beginning with the third byte at the start address in the postal indicia image memory 119 is verified with each dictionary image pattern in the postal indicia dictionary memory 120 (step 2105).

Figure 31:
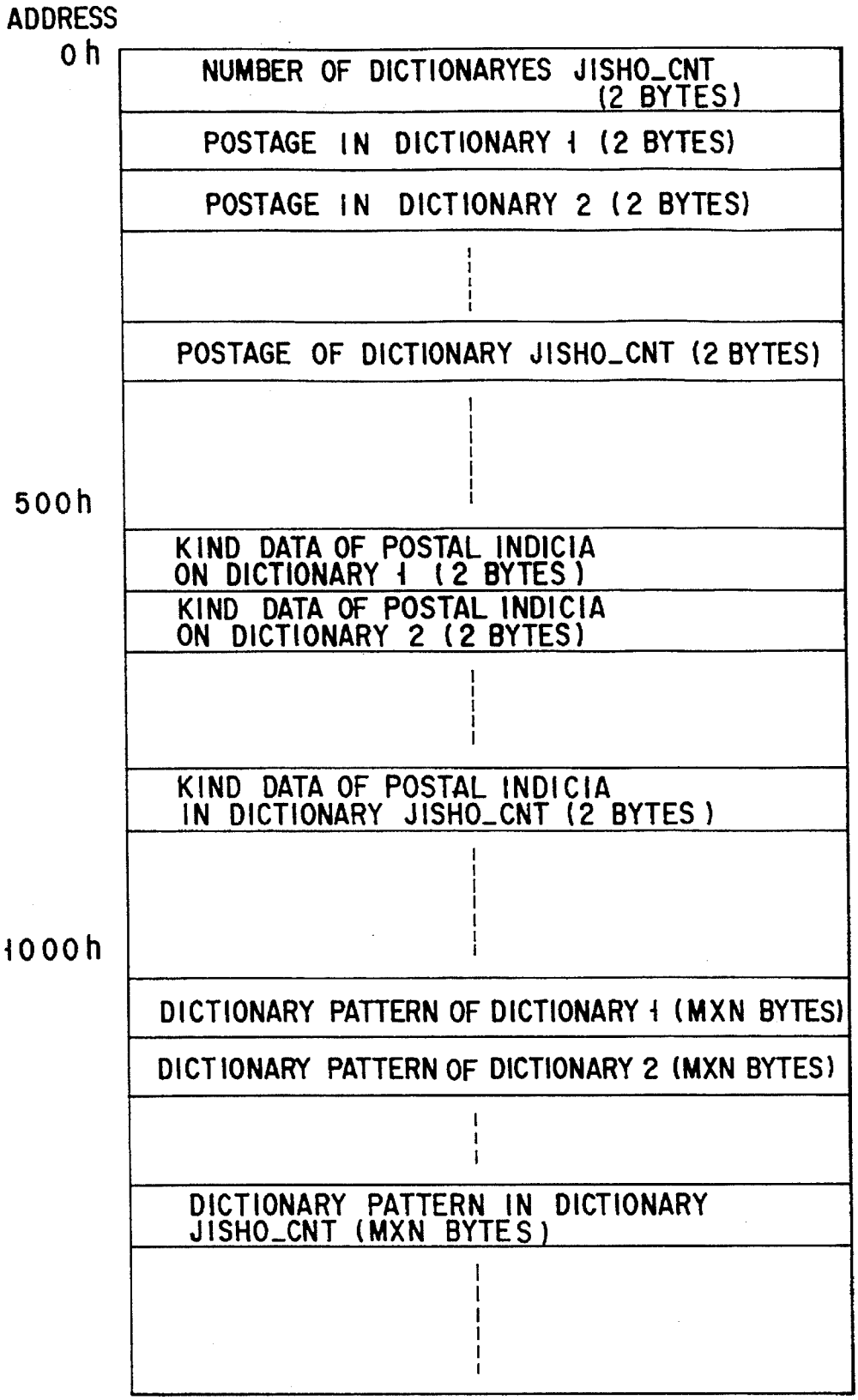
FIG. 31 illustrates an example of the address map of the postal indicia dictionary memory.

The dictionary pattern in the postal indicia dictionary memory 120 is stored in the form of an address map as shown in FIG. 31. In the two-byte area at the start address in the postal indicia dictionary memory 120, the total number of dictionary patterns JISHO_CNT is stored. From the third byte at the start address in the postal indicia dictionary memory 120, as many processing charges indicated by the individual dictionary patterns as JISHO_CNT are stored in consecutive two-byte areas. From address 500 h, as many information items INMEN_KIND representing the kinds of postal indicia indicated by each dictionary pattern as JISHO_CNT are stored in consecutive two-byte areas. From address 1000 h in the postal indicia dictionary memory 120, as many individual dictionary patterns with a size of M×N as JISHO_CNT are stored consecutively. In the case of postal indicia from which the processing charges cannot be known, such as separately paid impressions or postpaid impressions, 0 is stored as the charge.

Figure 32:
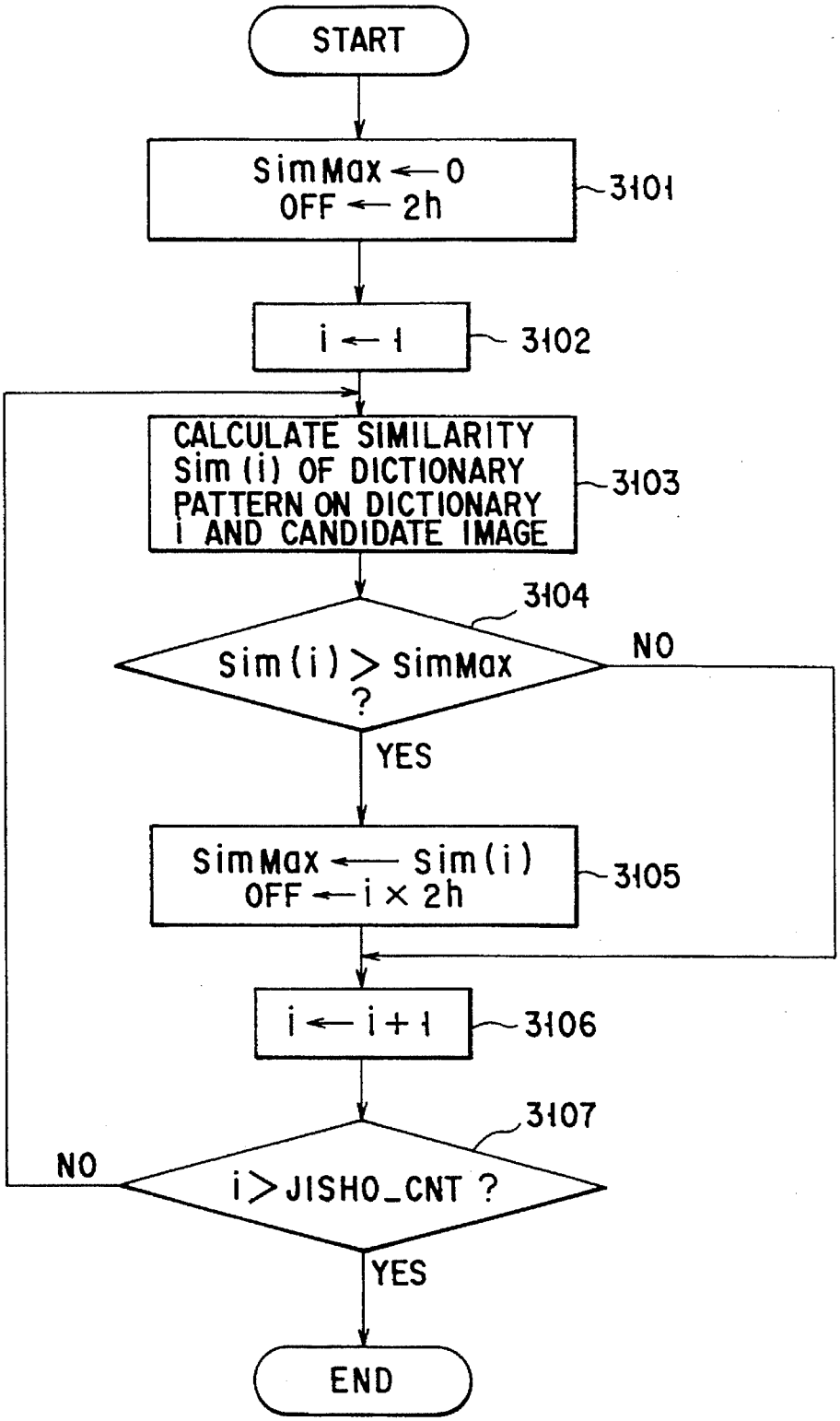
FIG. 32 is a flowchart for verifying the normalized postal indicia image with a dictionary pattern.

The procedure for performing the verification with respect to a dictionary pattern at step 2105 is as shown in FIG. 32, for example. First, the maximum value SimMax of similarity to be the first candidate is initialized to 0, and off indicating the start address in the charge storage area for the dictionary pattern with the maximum similarity is set to 2 h (step 3101).

The similarity between the image data in the postal indicia candidate area 1 and the first dictionary pattern i (initialized in step 3102) stored beginning with address 1000 h in the postal indicia dictionary memory 120 is calculated (step 3103).

If normalized two-dimensional image data g (x,y) with a size of M×N is expressed by a one-dimensional data string P(k) [k=1, 2, . . . , M×N], and similarly dictionary image data v(x,y) is expressed by a reference pattern D(k), an equation for determining the similarity is expressed as equation (1):

$$Sim = \Sigma(p(k) \times D(k))/(\sqrt{\Sigma(P(K))^2 \times (D(k))^2}) \quad (1)$$

If the similarity with the dictionary pattern i thus calculated is greater than the maximum similarity SimMax, ("Yes" at step 3104) the maximum similarity SimMax is replaced with the dictionary pattern i and off indicating the start address in the charge storage area for the dictionary pattern with the maximum similarity is set at 2 (step 3105). Otherwise ("NO" at step 3104), the process proceeds to step S3106 where counter i is increment. Similarly, the similarity between the image data in the postal indicia candidate area 1 and the dictionary pattern i stored beginning with the (1000 h+M×N×i)-th byte at the start address in the postal indicia dictionary memory 120 is computed in sequence. If the similarity with the dictionary pattern i is greater than the maximum similarity SimMax, the maximum similarity SimMax is replaced with the similarity with the dictionary pattern i and OFF indicating the start address in the charge storage area for the dictionary pattern with the maximum similarity, is set to 2×i (step 3105). This process is repeated as many times as the total number of dictionary patterns JISHO_CNT in the postal indicia dictionary memory 120, ("NO" at step 3107) and process returns to step 3103. Otherwise, the process terminates ("YES" at step 3107).

After the verification with respect to the dictionary patterns has been completed at step 2105, the maximum similarity obtained at step 2105, or the first candidate similarity SimMax is compared with a similarity reference value Simstd (e.g., 0.9) (step 2106). If the first candidate similarity SimMax is lower than the similarity reference value Simstd, it is determined that the postal indicia candidate area does not contain a postal indicia, the number of unsuitable ranges j is increased by 1 (step 2113). Then, the operation proceeds to step 2110 of FIG. 23. While, if the first candidate similarity SimMax is the similarity reference value Simstd or more, the processing charge stored in the two-byte area beginning with off indicating the start address for the charge storage area for the dictionary pattern with the first candidate similarity SimMax is read out, and furthermore, postal indicia candidate information INMEN_KIND stored in the two-byte area beginning with 500 h+(off−2 h) is read out (step 2107). Then, a check is made to see if INMEN_KIND is larger than 2, that is, to see if the image in the postal indicia candidate area is a postal indicia from which the processing charge cannot be known, such as a separately paid impression or a postpaid impression (2108). If it is a postal indicia from which the rate cannot be known, the total rate RYOKIN_TTL in the postal indicia is set to 0 (step 2114). Then, the process is terminated. If it is a postage stamp or a postage meter impression, the charge thereof is added to the accumulated total charge of postal indicia RYOKIN_TTL (step 2109).

Then, a similar process is performed repeatedly on the images in the remaining (RYOGAKU_CNT−1) postal indicia candidate areas stored beginning with the (M×N+3)-th byte at the start address in the postal indicia image memory 119 (steps 2110, 2111).

After the repeated process is completed, it is determined at step 2112 whether or not the unsuitable area j is equal to the number of postal indicia candidate areas RYOGAKU_CNT. If it is not equal to the latter, the process is terminated. If it is equal to the latter, control goes to step 2115.

Figure 33:
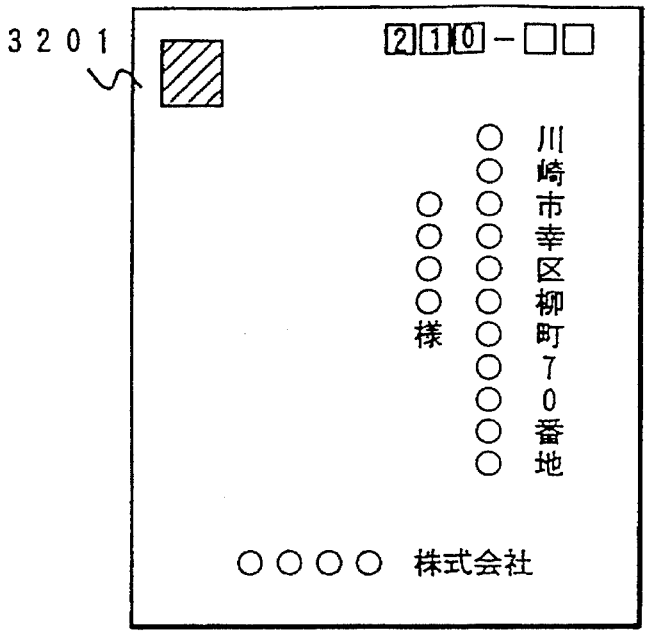
FIG. 33 shows an example of a postal indicia which has not been entered as a dictionary pattern.
Figure 34:
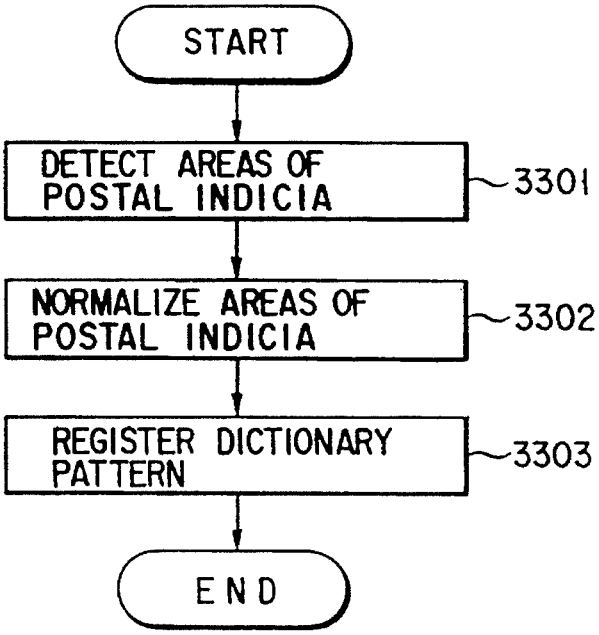
FIG. 34 is a flowchart for entering a new dictionary pattern.

The process of registering the image pattern of a new postal indicia into the postal indicia dictionary 120 will be described. The processing procedure is as shown in FIG. 34, for example. When the image of a piece of mail with a stamp not registered into the postal indicia dictionary 120 such as the postage stamp 3201 in FIG. 33 is stored in the mail image memory 118, for example, the postal indicia area is detected in a similar manner as step 2101 of FIG. 22 (step 3301). Then, the postal indicia area is normalized to a size of M×N in a similar manner as step 2103 (step 3302). By inputting a pattern registration instruction from the data input section 122 such as a keyboard, the value of JISHO_CNT+1 is stored in the two-byte area beginning with the start address, with the memory arrangement as shown in FIG. 35, for example, in addition to as many already stored dictionaries as JISHO_CNT, the postal indicia of the stamp is stored in the two byte area beginning with the (2×(JISHO_CNT+1)+1)-th byte at the start address, "1" indicating a postage stamp is stored in postal indicia type information INMEN_KIND stored in the two-byte area beginning with address 500 h+2×JISHO_CNT, and a dictionary pattern is entered into the M×N byte area beginning with address 1000 h+M×N×JISHO_CNT (step 3303). Similarly, such registration procedures hold true for image patterns other than postage stamps, such as postage meter impressions, separately paid impressions, postpaid impressions, or collect impressions.

The process of detecting the class of mail from the physical information on mail will be described.

A list of rates for first-class mail and second-class mail in Japan as of May 1993 is shown in FIG. 36. Mail is broadly divided into two types: standard-size mail and nonstandard-size mail. Furthermore, by weight, standard-size mail is subdivided into two divisions and nonstandard-size is subdivided into eight divisions. Standard-size mail is defined as mail with a length of 140 to 235 mm, a width of 90 to 120 mm, a thickness of less than 10 mm, and a weight of less than 50 g. Mail which does not meet these requirements is defined as nonstandard-size mail. It should be noted that mail with a length of less than 140 mm and a width of less than 90 mm, or mail one side of which is 600 mm or more or the total of three sides of which is 900 mm or more, or mail weighing 4 kg or more is not treated as ordinary mail.

Figure 37:
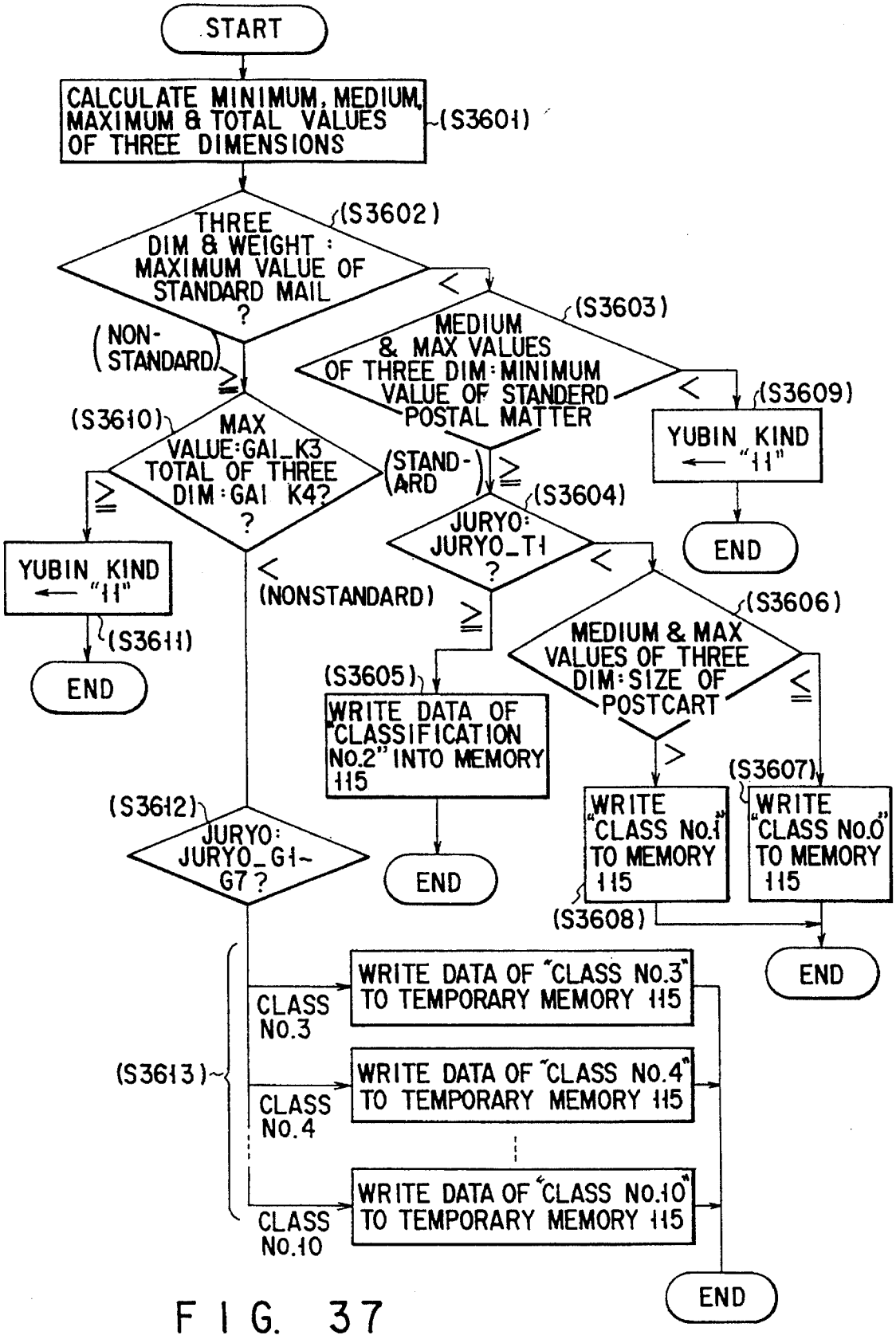
FIG. 37 is a flowchart for determining the kind of mail.

A mail type detecting process stored in the program storage section 114 will be described. On the basis of the information obtained at the physical quantity detection section, it is determined which of classes No. 0 to 10 in FIG. 36 the piece of mail detected falls under. FIG. 37 shows a processing flow, and FIG. 38 shows a postage look-up table (LUT) 121 prepared on the basis of the list of rates in FIG. 36. Before explanation of the flow, the contents of the LUT will be explained.

| | Practical value |
|---|---|
| 1) Numerical values concerning standard-size mail | |
| TEIKEI_K1; Standard-size mail's maximum thickness → | 10 mm |
| TEIKEI_K2; Standard-size mail's maximum width → | 120 mm |
| TEIKEI_K3; Standard-size mail's maximum length → | 235 mm |
| TEIKEI_J; Standard-size mail's maximum weight → | 50 g |
| 2) Numerical values concerning ranges treated as mail | |
| GAI_K1 ; Mail's minimum width → | 90 mm |
| GAI_K2 ; Mail's minimum length → | 140 mm |
| GAI_K3 ; Mail's maximum length → | 600 mm |
| GAI_K4 ; The maximum total length of three sides of a piece of mail → | 900 mm |
| GAI_J ; Mail's maximum weight → | 4000 g |
| 3) Numerical values concerning weight | |
| JURYO_T1 ; Standard-size mail's threshold → | 25 g |
| JURYO_G1 ; Nonstandard-size mail's threshold 1 → | 50 g |
| JURYO_G2 ; Nonstandard-size mail's threshold 2 → | 100 g |
| JURYO_G3 ; Nonstandard-size mail's threshold 3 → | 250 g |
| JURYO_G4 ; Nonstandard-size mail's threshold 4 → | 500 g |
| JURYO_G5 ; Nonstandard-size mail's threshold 5 → | 1000 g |
| JURYO_G6 ; Nonstandard-size mail's threshold 6 → | 2000 g |
| JURYO_G7 ; Nonstandard-size mail's threshold 7 → | 3000 g |
| 4) Numerical values concerning postage | |
| RYOKIN_N1; Postage for standard-size mail (class No. 1) → | 62 yen |
| RYOKIN_N2; Postage for standard-size mail (class No. 2) → | 72 yen |
| RYOKIN_N3; Postage for nonstandard-size mail (class No. 3) → | 120 yen |
| RYOKIN_N4; Postage for nonstandard-size mail (class No. 4) → | 175 yen |
| RYOKIN_N5; Postage for nonstandard-size mail (class No. 5) → | 250 yen |
| RYOKIN_N6; Postage for nonstandard-size mail (class No. 6) → | 360 yen |
| RYOKIN_N7; Postage for nonstandard-size mail (class No. 7) → | 670 yen |
| RYOKIN_N8; Postage for nonstandard-size mail (class No. 8) → | 930 yen |
| RYOKIN_N9; Postage for nonstandard-size mail (class No. 9) → | 1130 yen |
| RYOKIN_N10; Postage for nonstandard-size mail (class No. 10) → | 1340 yen |
| 5) Numerical values for special delivery | |
| RYOKIN_R1; Special delivery rate for standard-size mail (class No. 1) → | 272 yen |
| RYOKIN_R2; Special delivery rate for standard-size mail (class No. 2) → | 282 yen |
| RYOKIN_R3; Special delivery rate for nonstandard-size mail (class No. 3) → | 330 yen |
| RYOKIN_R4; Special delivery rate for nonstandard-size mail (class No. 4) → | 385 yen |
| RYOKIN_R5; Special delivery rate for nonstandard-size mail (class No. 5) → | 460 yen |
| RYOKIN_R6; Special delivery rate for nonstandard-size mail (class No. 6) → | 670 yen |
| RYOKIN_R7; Special delivery rate for nonstandard-size mail (class No. 7) → | 980 yen |
| RYOKIN_R8; Special delivery rate for nonstandard-size mail (class No. 8) → | 1500 yen |
| RYOKIN_R9; Special delivery rate for nonstandard-size mail (class No. 9) → | 1700 yen |
| RYOKIN_R10; Special delivery rate for nonstandard-size mail (class No. 10) → | 1910 yen |
| 6) Numerical values for postcard | |
| HAGAKI_K1; Maximum width of postcard → | 107 mm |
| HAGAKI_K2; Maximum length of postcard → | 150 mm |
| HAGAKI_NO; Postage for postcard (class No. 0) → | 41 yen |
| HAGAKI_RO; Special delivery rate for postcard (class No. 0) → | 251 yen |

The processing flow of FIG. 37 will be described. From the size data and the thickness data obtained at the physical quantity detection section, the minimum, intermediate value, and maximum of three sides of a piece of mail, and the total length of the three sides are computed. The width, length, and thickness information items are stored as KEIJO_W, KEIJO_H, and KEIJO_T in the temporary memory section 115, respectively. The minimum value obtained through calculation, the intermediate value, the maximum value, and the total of three sides are stored as KEIJO_MIN, KEIJO_MID, KEIJO_MAX, and KEIJO_TTL in the temporary memory section 115, respectively (S3601). The threshold data items in TEIKEI_K1 to K4 in the postage LUT 121 are compared with the above values (S3602). If none of the values exceed the threshold values, it is determined whether or not the intermediate value and the maximum value of three sides are equal to or larger than the threshold values in GAI_K1 and GAI_K2 in LUT (S3603). If they are equal to or larger than the threshold values, it is determined that the piece of mail is standard-size mail. Then, the weight measurement JURYO stored in the temporary memory section 115 is compared with the standard-size mail weight threshold JURYO_T1 to classify the piece of mail as one of the two subdivisions (S3604). If the weight is lower than the threshold value, the intermediate value and the maximum value of three sides are compared again with the maximum width HAGAKI_K1 and the maximum length HAGAKI_K2 of postcard (S3606). If both are lower than the threshold values, it is determined to be a postcard, and the postage for postcard RYOKIN_NO is read and stored in RYOKIN_LUT in the temporary memory section 115 (see FIG. 19). Similarly, the rate for special delivery postcard RYOKIN_NO is read and stored in RYOKIN_RPD in the temporary memory section 115. Then, after "0" indicating class No. 0 (see FIG. 36) is written in YUBIN_KIND (S3607), the process is terminated.

If it is determined to be class No. 1 by the comparison at step S3606, the following values are set at specific addresses in the temporary memory section 115 (S3608):

RYOKIN_LUT←RYOKIN_N1

RYOKIN_RPD←RYOKIN_R1

YUBIN_KIND←"1"

Similarly, if it is determined to be class No. 2 by the comparison at step 3604, the following values are set at specific addresses in the temporary memory section 115 (S3605):

RYOKIN_LUT←RYOKIN_N2

RYOKIN_RPD←RYOKIN_R2

YUBIN_KIND←"2"

Since the piece of mail judged to be nonstandard-size mail at step S3603 does not reach the size treated as mail, "11" indicating nonmail is written in YUBIN_KIND (S3609). Then the process is terminated.

If it is determined to be nonstandard-size mail at step S3602, the maximum size value KEIJO_MAX is compared with the threshold value GAI_K3 in the postage LUT 121, and the total of three sides KEIJO_TTL is compared with the threshold GAI_K4. If both are lower than the thresholds, they are determined to be nonstandard-size mail; otherwise, they are determined to be nonmail (S3610). In the case of nonmail, "11" is written in YUBIN_KIND (S3611) as at step S3609. Then, the process is terminated. If they are detected to be nonstandard-size mail, JURYO indicating the weight of mail is compared with JURYO_G1 to JURYO_G7 in the postage LUT 121 to determine which of class No. 3 to No. 10 they fall under (S3612). As in standard-size mail, suitable data items are set by type in RYOKIN_LUT, RYOKIN_RPD, and YUBIN_KIND (S3613) in the temporary memory section 115.

Figure 39:
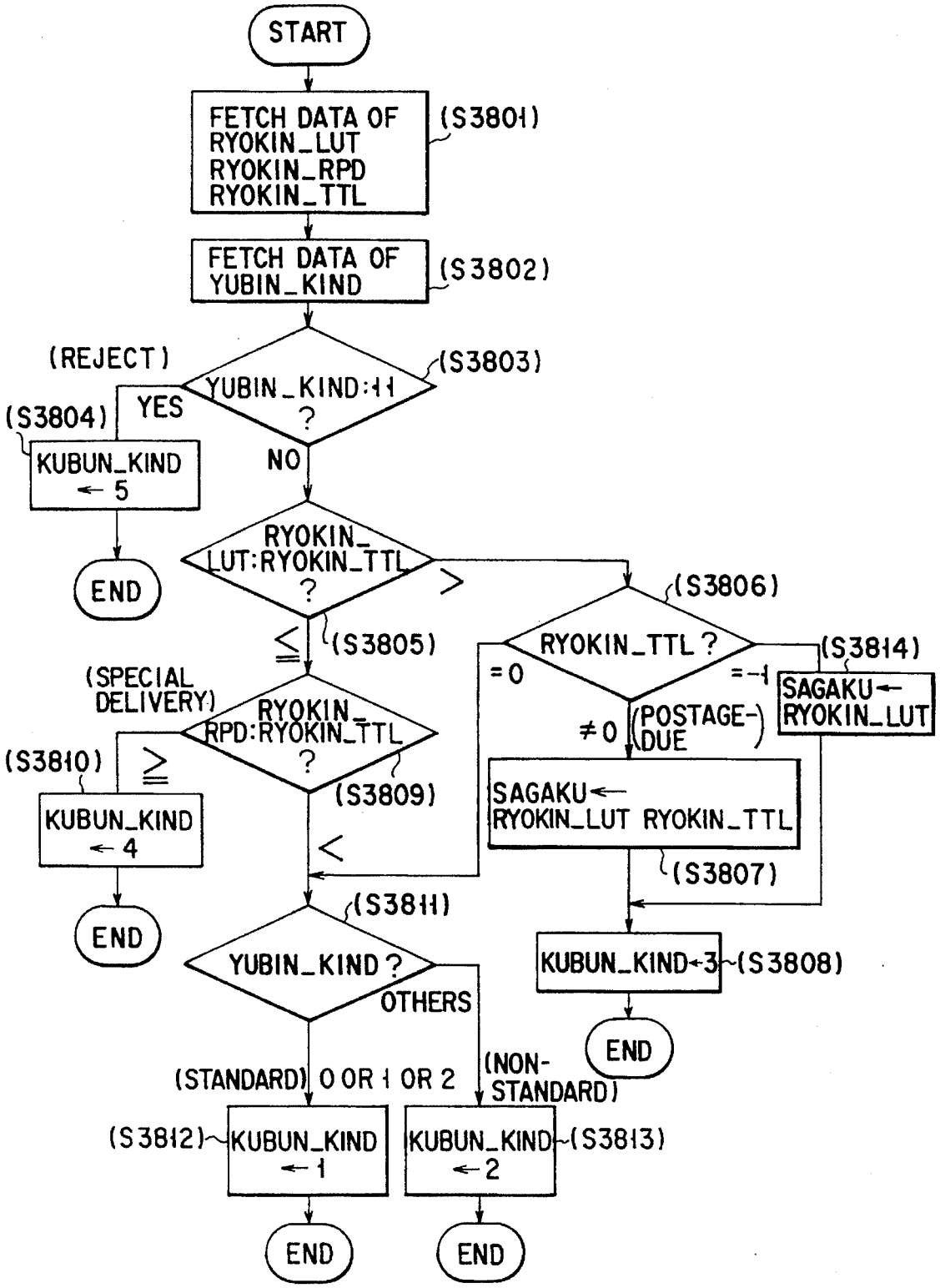
FIG. 39 is a flowchart for detecting mail classification information.

The process of evaluating the validity of charges and obtaining mail division information from the type information items classified according to the size and weight of mail and the charge information obtained from the image information on the postal indicia will be described, referring to the flowchart of FIG. 39. The following processing programs are stored in the program storage section 114.

The rate RYOKIN_LUT determined from the physical quantities of mail, the charge RYOKIN_RPD for special delivery, and the total charge RYOKIN_TTL obtained from the image information on the postal indicia are read from the temporary memory section 115 (S3801). Next, kind information YUBIN_KIND obtained from the physical quantities of mail is read from the temporary memory section 115 (S3802). When the value of YUBIN_KIND is "11," since the object is determined to be nonmail, "5" indicating reject is set in KUBUN_KIND in the temporary memory section 115 (S3803, S3804). If KUBUN_KIND has a value other than "11," RYOKIN_LUT is compared with RYOKIN_TTL (S3805) to judge whether or not the charge on the postal indicia is valid. When the former is larger, it means that the charge is insufficient. In the above-mentioned process of discriminating postal indicia, because "0" is written in RYOKIN_TTL for mail whose postage is unknown but not insufficient, such as separately paid mail or postpaid mail, RYOKIN TTL is checked (S3806). If "0" is written there, operation proceeds to step S3811. If "−1" is written there, it means that no postal indicia has been detected. Thus, it is determined that rate="0," valid charge RYOKIN_LUT is set as postage due in SAGAKU in the temporary memory section 115 (S3814), and "3" meaning postage due is set in KUBUN_KIND (S3808). Otherwise, it is judged that the postal indicia is present but the postage is insufficient. In this case, after the difference between the current postage and the valid postage RYOKIN_LUT is calculated and stored in SAGAKU in the temporary memory section 115 (S3807), "3" is set in KUBUN_KIND (S3808).

If it is determined that the postage is equal to or greater than the standard charge at step S3805, then it is checked whether the postage is equal to or larger than the special delivery charge (S3809). If it is greater than the special delivery charge, "4" meaning special delivery is set in KUBUN_KIND (S3810). In other cases, KUBUN_KIND indicating the mail type is read (S3811) If the value is "0", "1" or "2," "1" meaning standard-size mail is set in KUBUN_KIND; otherwise "2" meaning unknown-size mail is set there (S3812, S3813). FIG. 40 shows the relationship between the values of KUBUN_KIND and types of mail classified.

Figure 41:
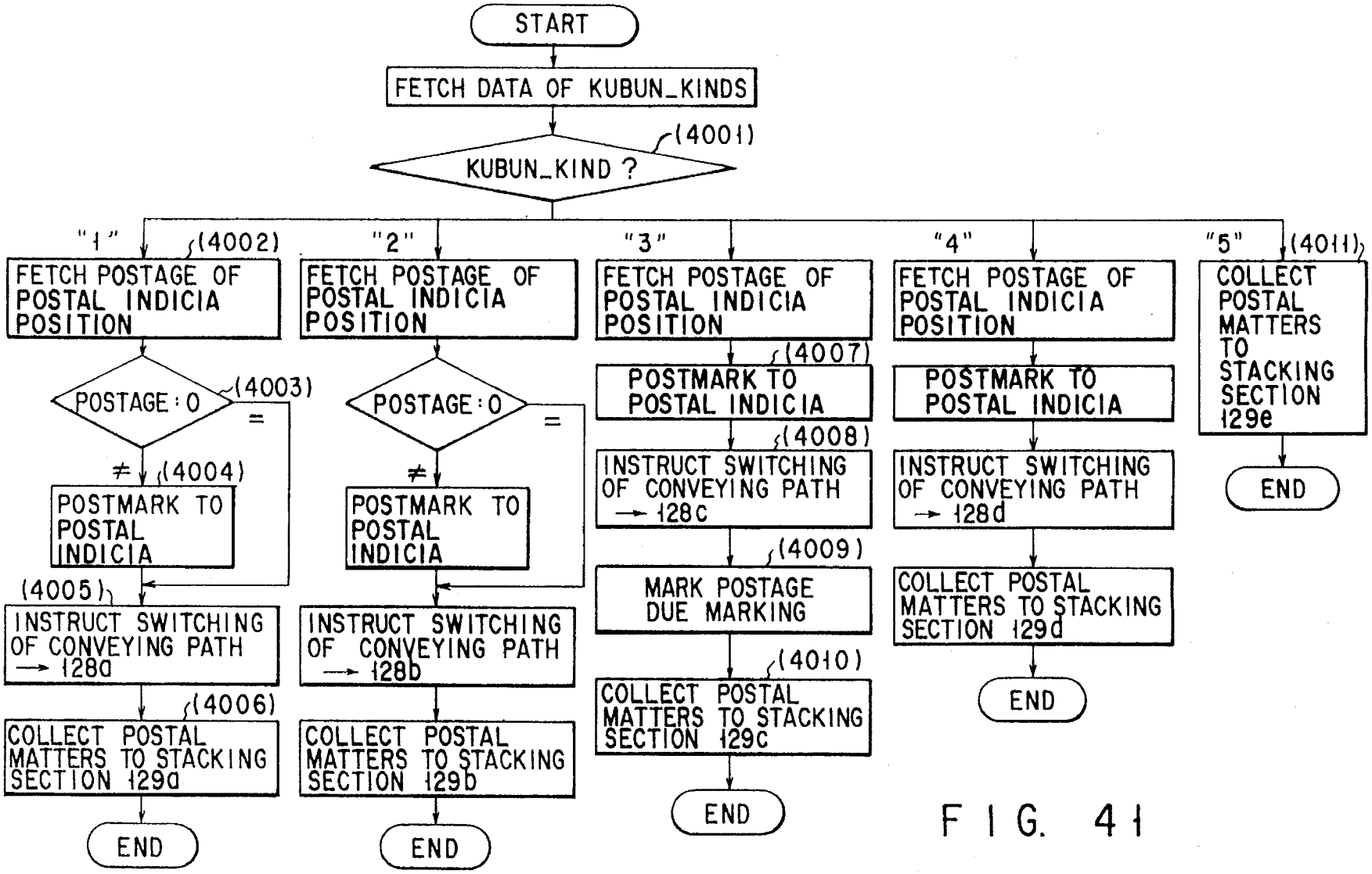
FIG. 41 is a flowchart for instructing the operation instruction section.

Explained next will be the process of giving a division instruction or a stamp instruction to the operation instructing section on the basis of mail division information. The following program is stored in the program storage section 114. FIG. 41 shows the processing flow. First, KUBUN_KIND in the temporary memory section 115 is read (4001) and, on the basis of the value, the contents of the process are determined. The process will be explained by the kind of mail.

(1) When KUBUN_KIND="1" (standard-size mail)

The positional information on the postal indicia obtained from the process of discriminating postal indicia and the total postage RYOKIN_TTL are read (4002). If the postage is not "0," at step 4003 it is necessary to put a postmark. Thus, a stamp instruction is sent to the postmark stamping means 126 on the basis of the positional information on the postal indicia and the detection signal from the mail position detector 125 placed near the postmark stamping means 126 (4004). If the postage is "0" at step 4003, the process proceeds to step 4005. Then, a transport path switching instruction is sent to the mail distribution means **128*a* (see FIG. 2) (4005), and pieces of mail are collected in the mail stacker 129*a* (4006**). Then, the process is terminated.

(2) When KUBUN_KIND="2" (nonstandard-size mail)

Sending a postmark stamping instruction is effected in the same manner as in item (1) (standard-size mail), except that the object to which a transport path switching instruction is sent is changed to distributor **128*b* and that the mail stacker is changed to stacker 129*b***.

(3) When KUBUN_KIND="3" (postage due)

The postal indicia portion is postmarked on the basis of the positional information on the postal indicia obtained from the process of discriminating postal indicia (4007), and a transport path switching instruction is sent to the mail distribution means 128*c* (4008). Then, a mark meaning postage due is stamped by the postage due mark stamping means 127 in a specific position of mail between the mail distribution means 128*c* and the stacker 129*c* (4009). This mark is stamped so that the operator of an automatic mail processor or the postman can recognize it with the naked eye even if a piece of mail with postage due piece of mail is mixed with other pieces of mail. The mark may always be the same. For example, postage due data SAGAKU stored in the temporary memory section 115 may be read to include the value in the mark. The piece of mail stamped with a postage due mark is collected in the stacker 129*c* (4010).

(4) When KUBUN_KIND="4" (special delivery)

Sending a postmark stamping instruction is effected in the same manner as in item (3), except that the object to which a transport path switching instruction is sent is changed to 128*d* and that the mail stacker is changed to 129*d*. In the present system, a judgment of special delivery is made on the basis of postal rates only. To improve the detection accuracy, for example, a system may be considered which extracts the special delivery mark or characters on mail by means of character recognition such as an OCR or a pattern matching process described in the process of discriminating postal indicia in the present invention.

(5) When KUBUN_KIND="5" (reject)

When it is determined to be nonmail, a transport path switching instruction is given to neither of the mail distribution means 128. Thus, the object goes straight on the transport path and is collected in the stacker 129*e* (4011).

Figure 49:
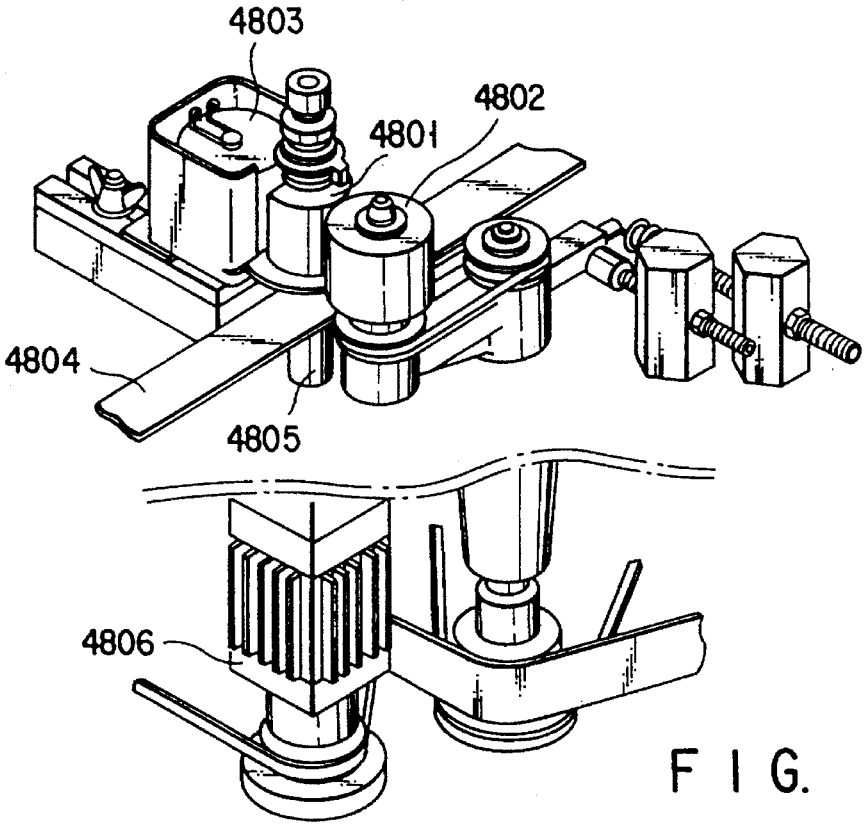
FIG. 49 is a perspective view of the postmark stamper.

An example of the postmark stamping means 126 is shown in FIG. 49. A print hub 4801 on whose side a print pattern is drawn and a backup roller 4802 for pressing a piece of mail against the hub from the opposite direction are arranged. The piece of mail gets caught between transport belts (not shown) and is conveyed on a mail guide 4804. An ink roller 4803 is pressed against the print hub 4801, on the opposite side of the transport path, thereby always supplying ink to the print hub 4801 for stamping. A print shaft 4805 transmits the rotational movement of a driving source (not shown) to the print hub 4801.

Hereinafter, the processing flow during stamping will be explained. At the moment when it is detected that the postal indicia portion of the piece of mail has reached between both rollers on the basis of the positional information on the postal indicia and the detection signal from the mail position detector 125 placed near the postmark stamping means 126, a driving source (not shown) starts by the instruction from the CPU 113, thereby rotating the print shaft 4805. In a stationary state, since the print hub 4801 faces the ink roller 4803, it is apart from the backup roller 4802. When rotated by the driving source, the printing surface of the print hub 4801 is pressed against the backup roller 4802 with the piece of mail caught between them. As a result, a postmark is put on the postal indicia. After the print shaft turns once, it stops by application of electromagnetic brake 4806 in the position where it was before the operation to prepare for the next stamping.

The postage due mark stamping means 127 can be realized with the same construction as that of the post-mark stamping means 126.

Figure 50:
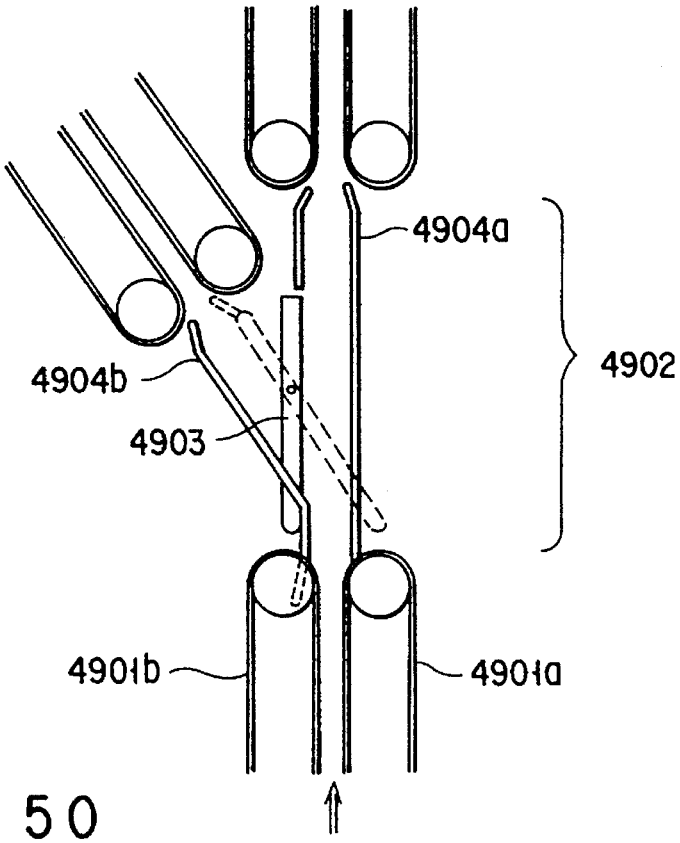
FIG. 50 is a schematic diagram of a mail distributing mechanism.

An example of the mail distribution means 128 is shown in FIG. 50. A piece of mail gets caught between a transport belts 4901*a* and 4901*b* and reaches a transport path switching section 4902. A sort-out plate 4903 swings through an angle almost equal to the angle between branch paths 4904*a* and 4904*b* to distribute pieces of mail to two paths. The sort-out plate 4903 is driven by, for example, a magnetic solenoid (not shown), and usually remains stationary in the position indicated by a solid line in FIG. 50. To cause the piece of mail to branch as a result of verifying the physical quantities with the postal rates, at the moment when it is determined that the piece of mail is approaching the vicinity of the transport path switching section 4902 on the basis of the detection signal from the mail position detector 125 (not shown) placed near the mail distribution means 126, current is allowed to flow through the electromagnetic solenoid by the instruction from the CPU 113, thereby causing the sort-out plate 4903 to swing to the position indicated by a broken line to allow the piece of mail to branch. After the mail position detector 125 (not shown) detects that the piece of mail has passed through the transport path switching section 4902 completely, the sort-out plate 4903 is returned to the solid-line position. Then, the process is terminated.

Hereinafter, a statistical process on mail will be described. As an example of statistical data, it is possible to take at least one of the following: statistics on the number of pieces of mail and on the total postage processed by the present system, statistics on the number of pieces of mail and on the total postage by type as shown in FIG. 36, statistics on the number of pieces of mail and on the total postage by processing division as described above, statistics on the number of pieces of mail by physical quantity, statistics on the number of pieces of mail by postage, and statistics on the number of pieces of mail by kind of postal indicia. There are two statistical data managing methods: one is to change data on the relevant item among the statistical data values as described above each time each object is processed, and the other is to store the process result for each object and then calculate the individual statistical data values in unison.

Figure 43:
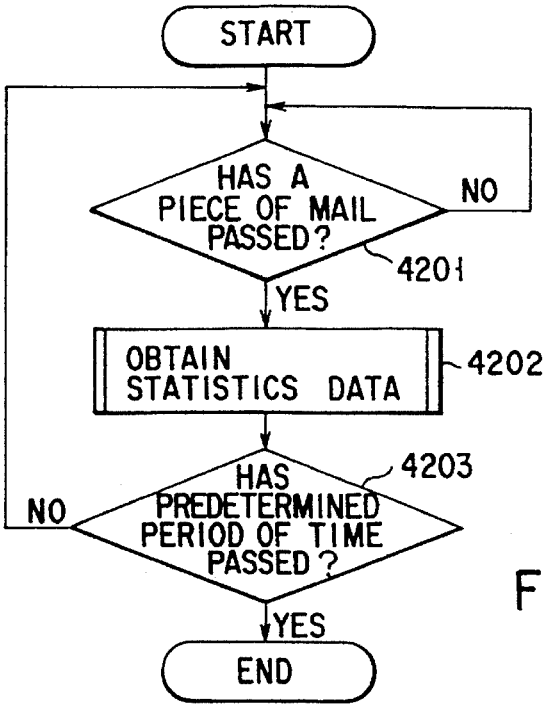
FIG. 43 is a flowchart for managing statistical data items.

A case where statistical data is managed by the former method will be explained. To execute the process, the program storage section 114 stores, for example, the processing procedures as shown in FIG. 43.

After the mail position detector 125 etc. have detected that the piece of mail has exited the thickness sensor 106 ("YES" obtained at step 4201), statistical data is gathered at step 4202, and it is determined whether a specific period of time (e.g., a specified date or one year) has elapsed, or whether the time required to process the pieces of mail in a lot has elapsed (step 4203). If it has not elapsed yet ("NO" at step 4203), process is returned to step 4201, and the processes are repeated until a piece of mail is detected. If it has elapsed, the process is terminated.

The statistical data acquisition means at step 4202 not explained above differs according to what is used as statistical data. Hereinafter, a case where various statistics such as the following are acquired will be explained: the total number of pieces of mail and the total postage for each of class 0 to class 10 in YUBIN_KIND indicating the type of mail as shown in FIG. 36, the total number of pieces of mail and the total postage for 4 and 3 in process division type KUBUN_KIND indicating special delivery and postage due, the total number of pieces of mail for 5 in process division type KUBUN_KIND indicating reject, and the total number of pieces of mail and the total postage except when process division type KUBUN_KIND is 5. These individual statistics are stored in the data storage section 116, beginning with the start address as shown in FIG. 42. These statistics are all initialized to 0 when the system operates for the first time. After such a management process is completed or after those statistics are copied to another recording medium periodically, those statistics may be cleared to 0.

Figure 46:
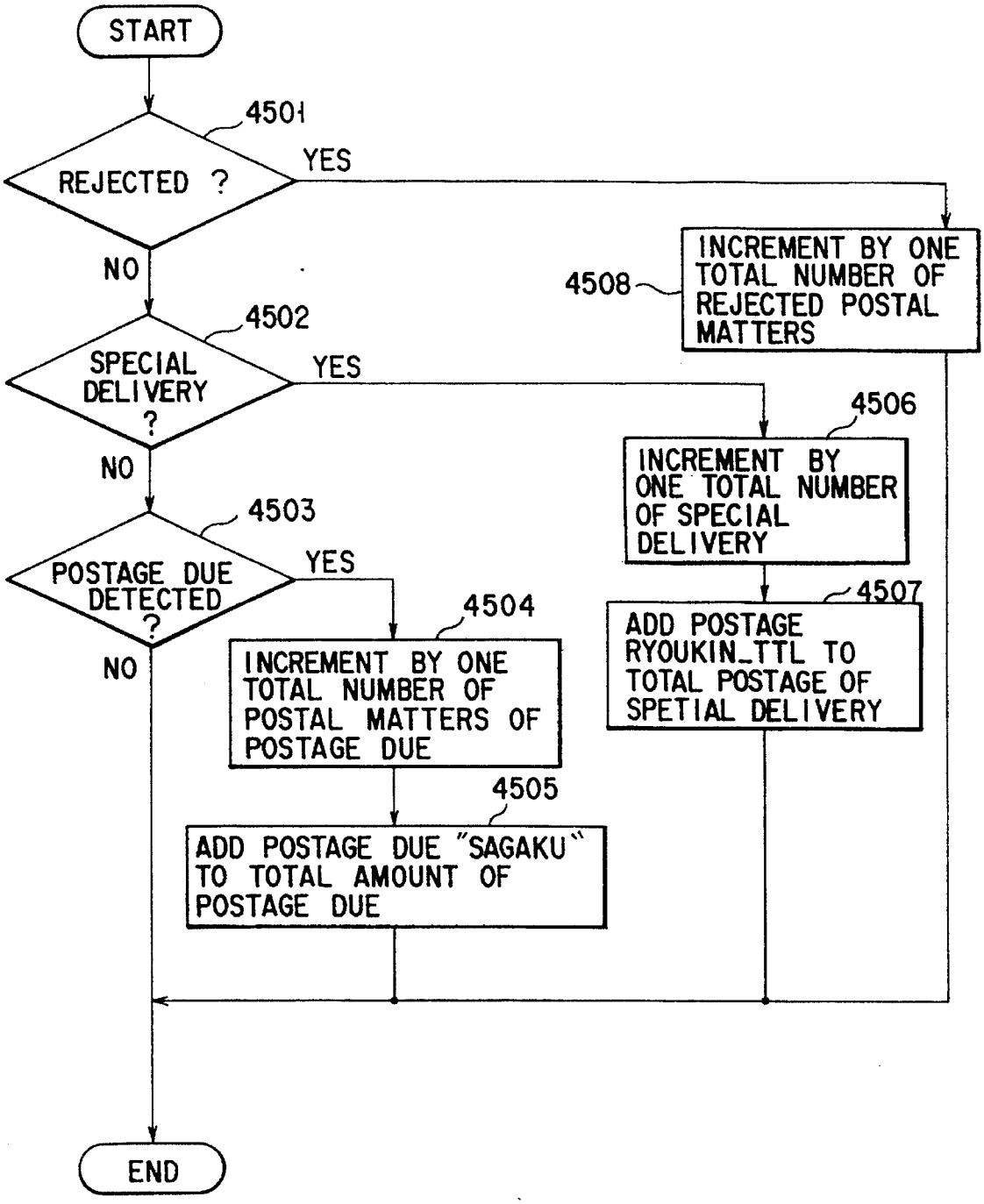
FIG. 46 is a flowchart for acquiring the statistical data items.
Figure 47:
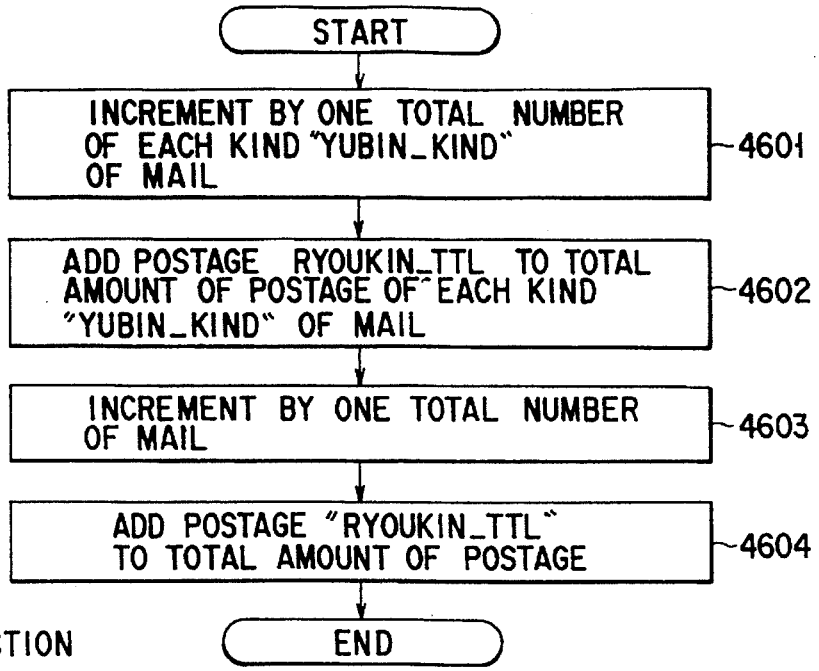
FIG. 47 is a flowchart for acquiring the different statistical data items.

To acquire statistical data, the program storage section 114 stores the processing procedures as shown in FIGS. 46 and 47, for example. First, the processing procedure in FIG. 46 will be explained.

A check is made to see if the value of KUBUN_KIND is equal to 5, or the piece of mail should be rejected (step 4501). If it should be rejected, the total number of rejects stored in the four-byte area starting at address 68*h* is increased by 1 (step 4508), and then the process is terminated. If it should not be rejected, a check is made to see if the value of KUBUN_KIND is equal to 4, or the piece of mail is special delivery (step 4502). If it is special delivery, the total number of special delivery items stored in the four-byte area starting at address 58*h* is increased by 1 (step 4506), postage RYOKIN_TTL is added to the total special delivery charges stored in the four-byte area starting at address 5Ch (step 4507), and then the process is terminated. If it is not special delivery, a check is made to see if the value of KUBUN_KIND is equal to 3, or the piece of mail is postage due (step 4503). If it is postage due ("YES" in step 4503), the process advances and, the total number of postage-due pieces of mail stored in the four-byte area starting at address 60*h* is increased by 1 (step 4504), postage difference SAGAKU is added to the amount of postage due for the total of postage due pieces of mail stored in the four-byte area starting at address 64*h* (step 4505), and then the process is terminated. If no postage is due ("NO" in step 4503), the process terminates immediately.

Hereinafter, the processing procedure of FIG. 47 will be described. The total number of pieces of mail in YUBIN_KIND stored in the four-byte area starting at the (8×the value of YUBIN_KIND+1)-th byte is increased by 1 (step 4601), and postage RYOKIN_TTL is added to the total postage in YUBIN KIND stored the next 4-byte area (step 4602). At step 4603, the total number of pieces of mail stored in the four-byte area starting at address 6Ch is increased by 1, and postage RYOKIN_TTL is added to the total postage stored in the four-byte area starting at address 70*h* (step 4604). Then, the process is terminated.

Statistics other than those described above are also acquired in a similar manner. For example, to obtain the statistic by the type of postal indicia, INMEN_KIND is used instead of YUBIN_KIND at step 4601 to increase the number of pieces of mail for each value of INMEN_KIND by 1. By suitably determining division ranges on the basis of the physical quantities including a piece of mail's width information KEIJO_W, length information KEIJO_H, thickness information KEIJO_T, and weight measurement JURYO, statistics concerning physical quantities can be acquired in a similar manner. In addition, among the above-described statistics, statistics can be obtained similarly even in such a combination as allows at least one statistics to be obtained.

Figure 45:
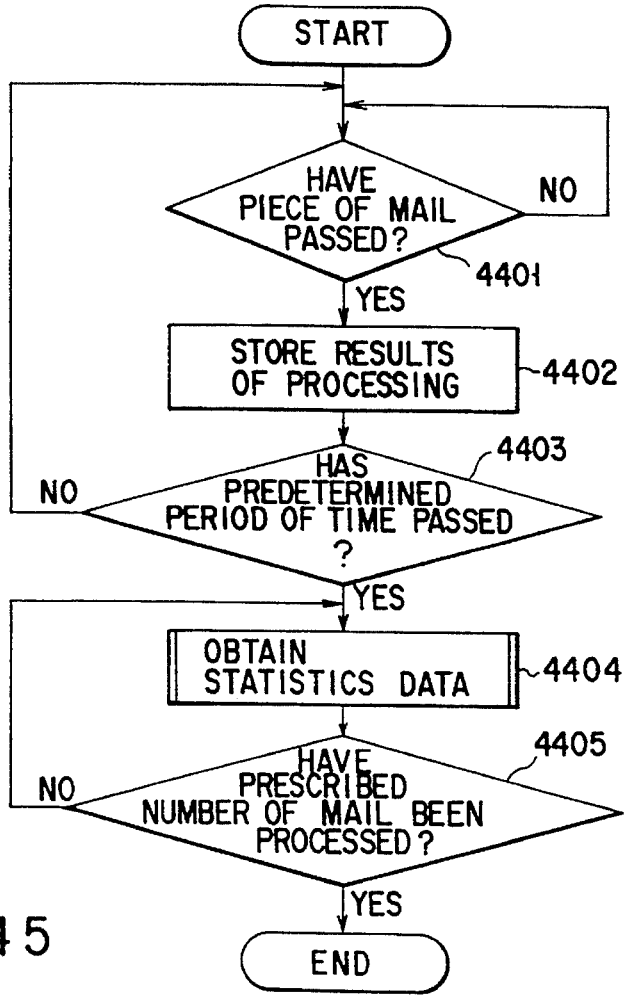
FIG. 45 is a flowchart for managing the different statistical data items.

Hereinafter, a case where statistical data is managed by the latter method will be explained. To execute this process, the program storage section 114 stores the processing procedure as shown in FIG. 45.

The process of step 4401 repeats until a piece of mail passes out of sensor 106 (while "NO" is obtained at step 4401). When a piece of mail is detected in step 4401 the individual process results such as RYOKIN_TTL stored in the temporary memory section 115 are stored together with mail identification information YUBIN_ID as shown FIG. 44 in the data storage section 116 (step 4402). For example, the value of identification information YUBIN_ID for the first processed piece of mail is "1", and similarly, the value of identification information YUBIN_ID for the i-th processed piece of mail is "i." The individual process results are stored in the 22-byte area starting at address RESULT_OFF+22×i, and the value of YUBIN_ID is stored in RESULT_CNT indicating the total number of processed pieces of mail in the four-byte area starting at address RESULT_OFF. Next, after step 4403 similar to step 4203 of FIG. 43 has been executed, control proceeds to the next step 4404. At step 4404, on the basis of the process results for each piece of mail stored at step 4402, the relevant statistical data items in a statistical data storage area (similar to FIG. 42) beginning with the start address as shown in FIG. 44 are changed sequentially. This process is repeated as many times as the value of RESULT_CNT (while "NO" is obtained in step 4405). Otherwise, if "YES" is obtained at step 4405, the process terminates.

Hereinafter, the process of outputting to the data output section 123 the physical information on pieces of mail, including the size and weight, the image information, the type information, the division information, the postage information, and mail discriminating results such as the value of statistical data will be described with reference to FIG. 48. The following processing program is stored in the program storage section 114.

Figure 48:
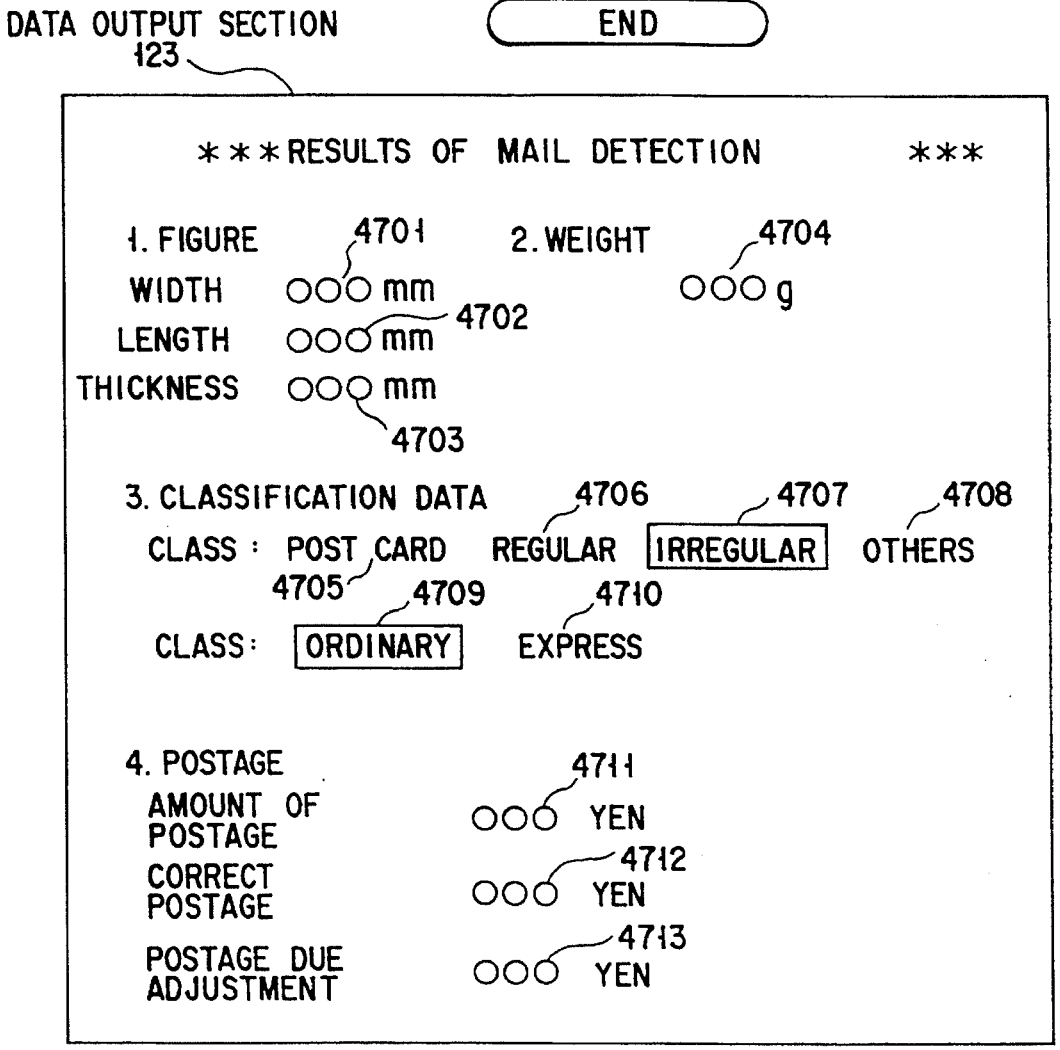
FIG. 48 shows a representation of the process result.

After the data output section 123 has displayed specific character information items in specific positions on, for example, a CRT, the values of a piece of mail's width information KEIJO_W, length information KEIJO_H, thickness information KEIJO_T, and weight measurement value JURYO stored in the temporary memory section 115 are displayed in the places indicated by reference numerals 4701 to 4704 in FIG. 48. When the value of YUBIN_KIND indicating the type of mail stored in the temporary memory section 115 is "0," the object is a post card, so that location 4705 is given; when the value is "1" or "2," location 4706 indicating standard-size mail is given; when the value is any one of "3" to "10," location 4707 indicating nonstandard-size mail is given; furthermore, when the value is "11," location 4708 is given. Then, the characters displayed in the corresponding locations are made brighter or colored. When the value of KUBUN_KIND indicating the mail processing division stored in the temporary memory section 115 is "4," the characters displayed in location 4710 indicating special delivery, otherwise in location 4709 are made brighter or colored. In FIG. 48, location 4707 and location 4709 are selected. Then, the value of total postage RYOKIN_TTL obtained from the image information on the postal indicia stored in the temporary memory section 115 and that of valid postage RYOKIN_LUT are displayed in location 4711 and location 4712. Furthermore, the value obtained by subtracting RYOKIN_LUT from RYOKIN_TTL is displayed in location 4713. In this way, the operator is informed of the results of detecting the object. Similarly, the mail image information stored in the mail image memory 118 and the statistical data items stored in the data storage section 116 can also be displayed.

The data communication section 124 in the input/output section is an apparatus for linking with an external communication line such as a modem and transmitting data. Using the data communication section 124, the host computer can pump up statistical data items including the total number of processes per day and the amount of money processed. Furthermore, when a new postal indicia such as a commemorative stamp is issued, it is possible to update the dictionary in the postal indicia dictionary memory 120 using the communication line.

While in the embodiment, the invention has been applied only to domestic first-class mail and second-class mail, it is not limited to these. For instance, the invention may be applied to third-class mail and fourth-class mail, and further to ordinary packages, bookrate packages, and home delivery service. Although in the embodiment, postage is determined only by physical information and special delivery information on the mail, the invention may be applied to a postage system where postage differs with the destination or the days required for delivery, such as a postage system applied to overseas mail, without departing from the scope of the invention.

In addition to a method of weighing a load, the weight sensor 105 produces a similar result by a method of forcing the object to collide with a barrier provided in the transport path and measuring the impulse and the speed to determine the weight. The optical read sensor 103 may be a two-dimensional area sensor instead of a one-dimensional sensor. Furthermore, of the image information items obtained by the sensor 103, the values obtained by converting YUBIN_W and YUBIN_H indicating the outer appearance of a piece of mail into units of length may be determined to be KEIJO_W and KEIJO_H indicating mail's shape information. In this case, the size sensor 104 and the size detecting section 110 are not necessary. The sensor 103 may be a color read sensor. In this case, color information may be sensed as a physical quantity of an object, which enables the invention to be applied to a system where postage differs with the color of an object, for example.

While in the embodiment, the transport path is achieved by a belt, the object does not necessarily move. For example, the invention may be applied to a measuring instrument which senses the weight and size of a piece of mail at a window in a post office and displays the postage.

As described above in detail, with the present invention, by measuring the physical information on an object in connection with postage, such as the size, thickness, and weight, calculating the valid postage on the basis of a postage table for the physical quantities previously stored, and discriminating the postage on the postal indicia on the object through an image information process, it is determined whether or not the valid postage determined by the physical information has been paid. According to the result, the object can be classified. Statistical data on each type or on the postage for all objects or the number of pieces of mail can be measured. Furthermore, an indicator can be used to display the detected result.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A mail processing apparatus comprising:

means for detecting physical quantities of mail provided with a stamp so as to determine a processing charge of the mail;

first determining means for determining the processing charge of the mail in accordance with the physical quantities detected by said detecting means;

means for storing a plurality of reference images corresponding to images of a plurality of stamps of different postal indicia;

means for extracting the images of the stamps of the mail;

second determining means for determining a postal indicia of the stamp of the mail by comparing the image extracted by said extracting means with the plurality of reference images stored in said storing means;

means for verifying the processing charge determined by said first determining means and the postal indicia of the mail determined by said second determining means; and third determining means for determining a processing method of the mail based on a verification result obtained by said verifying means.

2. A mail processing apparatus according to claim 1, wherein said first determining means comprises means for storing a conversion table denoting a relationship between the physical quantities of the mail and the processing charge; and means for determining the processing charge of the mail from the physical quantities detected by said detecting means based on the conversion table stored in said storing means.

3. A mail object processing apparatus according to claim 1, wherein said third determining means comprises means for classifying said mail according to at least one of a physical quantity detected by said detecting means, the determined processing charge, and the validity of the postal indicia affixed on the mail according to the physical quantities.

4. A mail processing apparatus according to claim 1, wherein said third determining means comprises means for collecting statistical data on said mail by using at least one of said physical quantities obtained from said physical quantity detecting means, said charge, said postal indicia obtained from said second determining means, and a verification result obtained from said verifying means.

5. A mail processing apparatus according to claim 1, wherein said third determining means comprises means for displaying information items on said mail by using at least one of said physical quantities obtained by said physical quantity detecting means, said charge, said postal indicia obtained from said second determining means, and a verification result obtained form said verifying means.

6. A mail processing apparatus according to claim 1, wherein said storing means comprises means for fetching stamp reference image data, postal indicia reference identification values data, and mail class reference identification data.

7. A mail processing apparatus according to claim 1, wherein said second determining means comprises means for comparing each of said image of the stamps with the stored images to obtain a postal indicia corresponding to a reference image most similar to the extracted image; means for fetching the postal indicia obtained as a result of the comparison P reformed by said comparing means; and totalizing means for calculating a total sum of the postal indicia for a plurality of stamps on the mail.

8. A mail object processing apparatus according to claim 7, wherein said third determining means comprises means for comparing the processing charge obtained by said first determining means with the total sum of the postal indicia by said totalizing means, and determining whether the mail is special mail or ordinary mail.

9. A mail processing apparatus according to claim 7, wherein said fixing means comprises means for determining whether the total sum of the postal indicia of the stamps put on the mail is valid or not, means for putting a postmark indicating "used" on said stamp when the postal indicia affixed on said mail is valid, and means for comparing the processing charge obtained by said first determining means with the total sum of the postal indicia obtained from said totalizing means and putting a postage due mark on the mail.

10. A mail processing apparatus comprising:

physical quantity detecting means for detecting physical information serving as factors that determine processing charges for mail with a stamp, by quantifying the information to obtain physical quantities;

first means for storing a conversion table which shows a relationship between the physical quantities and the charges;

charge determining means for determining a processing charge for said mail with reference to said conversion table on the basis of said physical quantities;

extracting means for extracting image information including the stamp image of said mail;

second means for storing a plurality of reference image data indicating a plurality of stamp images;

means for determining the kind of said stamp image on the basis of the image information extracted by said extracting means using said reference image data;

postal indicia detecting means for detecting the postal indicia from said determined stamps image; and means for verifying the processing charge for said mail obtained from said charge determining means with the postal indicia affixed on said mail obtained from said postal indicia detecting means.

11. An automatic processing apparatus for mail to be processed, comprising:

means for taking in mail with a stamp put on a surface of the mail to be processed;

a transport path for transporting the mail taken in by said taking means;

physical quantity detecting means having a plurality of sensors which are provided along the transport path in sequence, for detecting a plurality of physical information items serving as factors that determine a processing charge for the mail by quantifying the items to obtain physical quantities;

first means for storing a conversion table representing a relationship between the physical quantities and processing charges;

charge determining means for determining a processing charge for said mail with reference to said conversion table using said physical quantities;

extracting means for extracting image information including the stamp of said mail;

second means for storing a plurality of reference image data items indicating a plurality of stamp images;

means for determining the kind of said stamp image on the basis of the image information extracted by said extracting means using said reference image data;

postal indicia detection means for detecting the postal indicia from said determined stamp image; and means for verifying the processing charge for said mail obtained from said charge determining means with the postal indicia affixed on said mail obtained from said postal indicia detection means.

* * * * *